US009230491B2

(12) United States Patent
Ikeda

(10) Patent No.: US 9,230,491 B2
(45) Date of Patent: Jan. 5, 2016

(54) IMAGE DISPLAY APPARATUS AND CONTROL METHOD THEREFOR

(71) Applicant: CANON KABUSHIKI KAISHA, Tokyo (JP)

(72) Inventor: Takeshi Ikeda, Ebina (JP)

(73) Assignee: Canon Kabushiki Kaisha, Tokyo (JP)

( * ) Notice: Subject to any disclaimer, the term of this patent is extended or adjusted under 35 U.S.C. 154(b) by 30 days.

(21) Appl. No.: 14/289,096

(22) Filed: May 28, 2014

(65) Prior Publication Data

US 2014/0354708 A1 Dec. 4, 2014

(30) Foreign Application Priority Data

May 29, 2013 (JP) ..... 2013-113160
Apr. 30, 2014 (JP) ..... 2014-093398

(51) Int. Cl.
*G09G 5/10* (2006.01)
*G09G 3/34* (2006.01)

(52) U.S. Cl.
CPC ..... *G09G 3/3426* (2013.01); *G09G 2320/0247* (2013.01); *G09G 2320/064* (2013.01); *G09G 2320/0653* (2013.01)

(58) Field of Classification Search
CPC ..... G09G 5/02; G09G 2300/0452; G09G 2300/0819; G09G 2320/0276; G09G 2320/041; G09G 2300/0842; G09G 2320/0242
See application file for complete search history.

(56) References Cited

U.S. PATENT DOCUMENTS

| | | | | |
|---|---|---|---|---|
| 8,711,083 | B2 * | 4/2014 | Lee et al. | 345/102 |
| 2005/0184952 | A1 * | 8/2005 | Konno et al. | 345/102 |
| 2010/0052575 | A1 * | 3/2010 | Feng et al. | 315/308 |
| 2011/0304657 | A1 * | 12/2011 | Yamamura et al. | 345/690 |

FOREIGN PATENT DOCUMENTS

| | | | | |
|---|---|---|---|---|
| JP | 3523170 | B2 | 4/2004 | |
| JP | 2009-181075 | A | 8/2009 | |
| JP | 2010-122669 | A | 6/2010 | |
| JP | 2012-128813 | A | 7/2012 | |
| WO | WO 2010020949 | * | 2/2010 | G09G 3/34 |

OTHER PUBLICATIONS

The above foreign patent documents were cited in the Jun. 30, 2015 Japanese Office Action, which is enclosed without an English Translation, that issued in Japanese Patent Application No. 2014-093398.

* cited by examiner

*Primary Examiner* — Olga Merkoulova
(74) *Attorney, Agent, or Firm* — Cowan, Liebowitz & Latman, P.C.

(57) ABSTRACT

A frame image is divided into a plurality of divided areas, and it is determined whether each of the divided areas is a first region including a predetermined object or a second region not including the object. A brightness of each light emitting block is decided based on a result of the determination of each divided area. In cases where a divided area determined as the second region in a target frame has been determined as the first region in frames, which satisfy a predetermined condition, among past frames, the brightness of a light emitting block corresponding to the divided area is decided to a brightness closer to the brightness of a light emitting block corresponding to a divided area determined as the first region as compared to the brightnesses of light emitting blocks corresponding to the other divided areas determined as the second region.

21 Claims, 28 Drawing Sheets

| | 1 | 2 | 3 | 4 | 5 | 6 | 7 | 8 | 9 | 10 |
|---|---|---|---|---|---|---|---|---|---|---|
| 1 | 128 | 128 | 128 | 128 | 128 | 128 | 128 | 128 | 128 | 128 |
| 2 | 0 | 0 | 0 | 0 | 0 | 160 | 80 | 0 | 0 | 0 |
| 3 | 0 | 0 | 0 | 0 | 0 | 200 | 50 | 0 | 0 | 0 |
| 4 | 0 | 0 | 0 | 0 | 0 | 200 | 50 | 0 | 0 | 0 |
| 5 | 0 | 0 | 0 | 0 | 0 | 160 | 0 | 0 | 0 | 0 |
| 6 | 0 | 0 | 0 | 0 | 0 | 0 | 0 | 0 | 0 | 0 |
| 7 | 0 | 0 | 0 | 0 | 0 | 0 | 0 | 0 | 0 | 0 |

CHARACTERISTIC AMOUNT
AT POSITION OF A

*Fig.3A*

| | 1 | 2 | 3 | 4 | 5 | 6 | 7 | 8 | 9 | 10 |
|---|---|---|---|---|---|---|---|---|---|---|
| 1 | 128 | 128 | 128 | 128 | 128 | 128 | 128 | 128 | 128 | 128 |
| 2 | 0 | 0 | 0 | 0 | 0 | 0 | 0 | 0 | 0 | 0 |
| 3 | 0 | 0 | 0 | 0 | 0 | 160 | 80 | 0 | 0 | 0 |
| 4 | 0 | 0 | 0 | 0 | 0 | 200 | 50 | 0 | 0 | 0 |
| 5 | 0 | 0 | 0 | 0 | 0 | 200 | 50 | 0 | 0 | 0 |
| 6 | 0 | 0 | 0 | 0 | 0 | 160 | 0 | 0 | 0 | 0 |
| 7 | 0 | 0 | 0 | 0 | 0 | 0 | 0 | 0 | 0 | 0 |

CHARACTERISTIC AMOUNT
AT POSITION OF B

*Fig.3B*

| | 1 | 2 | 3 | 4 | 5 | 6 | 7 | 8 | 9 | 10 |
|---|---|---|---|---|---|---|---|---|---|---|
| 1 | 128 | 128 | 128 | 128 | 128 | 128 | 128 | 128 | 128 | 128 |
| 2 | 0 | 0 | 0 | 0 | 0 | 0 | 0 | 0 | 0 | 0 |
| 3 | 0 | 0 | 0 | 0 | 0 | 0 | 0 | 0 | 0 | 0 |
| 4 | 0 | 0 | 0 | 0 | 0 | 160 | 80 | 0 | 0 | 0 |
| 5 | 0 | 0 | 0 | 0 | 0 | 200 | 50 | 0 | 0 | 0 |
| 6 | 0 | 0 | 0 | 0 | 0 | 200 | 50 | 0 | 0 | 0 |
| 7 | 0 | 0 | 0 | 0 | 0 | 160 | 0 | 0 | 0 | 0 |

CHARACTERISTIC AMOUNT
AT POSITION OF C

*Fig.3C*

| | 1 | 2 | 3 | 4 | 5 | 6 | 7 | 8 | 9 | 10 |
|---|---|---|---|---|---|---|---|---|---|---|
| 1 | 1 | 1 | 1 | 1 | 1 | 1 | 1 | 1 | 1 | 1 |
| 2 | 0 | 0 | 0 | 0 | 0 | 1 | 1 | 0 | 0 | 0 |
| 3 | 0 | 0 | 0 | 0 | 0 | 1 | 1 | 0 | 0 | 0 |
| 4 | 0 | 0 | 0 | 0 | 0 | 1 | 1 | 0 | 0 | 0 |
| 5 | 0 | 0 | 0 | 0 | 0 | 1 | 0 | 0 | 0 | 0 |
| 6 | 0 | 0 | 0 | 0 | 0 | 0 | 0 | 0 | 0 | 0 |
| 7 | 0 | 0 | 0 | 0 | 0 | 0 | 0 | 0 | 0 | 0 |

DIAGNOSTIC REGION DETERMINATION RESULT AT POSITION OF A

*Fig.4A*

| | 1 | 2 | 3 | 4 | 5 | 6 | 7 | 8 | 9 | 10 |
|---|---|---|---|---|---|---|---|---|---|---|
| 1 | 1 | 1 | 1 | 1 | 1 | 1 | 1 | 1 | 1 | 1 |
| 2 | 0 | 0 | 0 | 0 | 0 | 0 | 0 | 0 | 0 | 0 |
| 3 | 0 | 0 | 0 | 0 | 0 | 1 | 1 | 0 | 0 | 0 |
| 4 | 0 | 0 | 0 | 0 | 0 | 1 | 1 | 0 | 0 | 0 |
| 5 | 0 | 0 | 0 | 0 | 0 | 1 | 1 | 0 | 0 | 0 |
| 6 | 0 | 0 | 0 | 0 | 0 | 1 | 0 | 0 | 0 | 0 |
| 7 | 0 | 0 | 0 | 0 | 0 | 0 | 0 | 0 | 0 | 0 |

DIAGNOSTIC REGION DETERMINATION RESULT AT POSITION OF B

*Fig.4B*

| | 1 | 2 | 3 | 4 | 5 | 6 | 7 | 8 | 9 | 10 |
|---|---|---|---|---|---|---|---|---|---|---|
| 1 | 1 | 1 | 1 | 1 | 1 | 1 | 1 | 1 | 1 | 1 |
| 2 | 0 | 0 | 0 | 0 | 0 | 0 | 0 | 0 | 0 | 0 |
| 3 | 0 | 0 | 0 | 0 | 0 | 0 | 0 | 0 | 0 | 0 |
| 4 | 0 | 0 | 0 | 0 | 0 | 1 | 1 | 0 | 0 | 0 |
| 5 | 0 | 0 | 0 | 0 | 0 | 1 | 1 | 0 | 0 | 0 |
| 6 | 0 | 0 | 0 | 0 | 0 | 1 | 1 | 0 | 0 | 0 |
| 7 | 0 | 0 | 0 | 0 | 0 | 1 | 0 | 0 | 0 | 0 |

DIAGNOSTIC REGION DETERMINATION RESULT AT POSITION OF C

*Fig.4C*

| | 1 | 2 | 3 | 4 | 5 | 6 | 7 | 8 | 9 | 10 |
|---|---|---|---|---|---|---|---|---|---|---|
| 1 | 100 | 100 | 100 | 100 | 100 | 100 | 100 | 100 | 100 | 100 |
| 2 | 10 | 10 | 10 | 10 | 10 | 100 | 100 | 10 | 10 | 10 |
| 3 | 10 | 10 | 10 | 10 | 10 | 100 | 100 | 10 | 10 | 10 |
| 4 | 10 | 10 | 10 | 10 | 10 | 100 | 100 | 10 | 10 | 10 |
| 5 | 10 | 10 | 10 | 10 | 10 | 100 | 10 | 10 | 10 | 10 |
| 6 | 10 | 10 | 10 | 10 | 10 | 10 | 10 | 10 | 10 | 10 |
| 7 | 10 | 10 | 10 | 10 | 10 | 10 | 10 | 10 | 10 | 10 |

PRELIMINARILY DETERMINED LIGHTING BRIGHTNESS AT POSITION OF A

*Fig.5A*

| | 1 | 2 | 3 | 4 | 5 | 6 | 7 | 8 | 9 | 10 |
|---|---|---|---|---|---|---|---|---|---|---|
| 1 | 100 | 100 | 100 | 100 | 100 | 100 | 100 | 100 | 100 | 100 |
| 2 | 10 | 10 | 10 | 10 | 10 | 10 | 10 | 10 | 10 | 10 |
| 3 | 10 | 10 | 10 | 10 | 10 | 100 | 100 | 10 | 10 | 10 |
| 4 | 10 | 10 | 10 | 10 | 10 | 100 | 100 | 10 | 10 | 10 |
| 5 | 10 | 10 | 10 | 10 | 10 | 100 | 100 | 10 | 10 | 10 |
| 6 | 10 | 10 | 10 | 10 | 10 | 100 | 10 | 10 | 10 | 10 |
| 7 | 10 | 10 | 10 | 10 | 10 | 10 | 10 | 10 | 10 | 10 |

PRELIMINARILY DETERMINED LIGHTING BRIGHTNESS AT POSITION OF B

*Fig.5B*

| | 1 | 2 | 3 | 4 | 5 | 6 | 7 | 8 | 9 | 10 |
|---|---|---|---|---|---|---|---|---|---|---|
| 1 | 100 | 100 | 100 | 100 | 100 | 100 | 100 | 100 | 100 | 100 |
| 2 | 10 | 10 | 10 | 10 | 10 | 10 | 10 | 10 | 10 | 10 |
| 3 | 10 | 10 | 10 | 10 | 10 | 10 | 10 | 10 | 10 | 10 |
| 4 | 10 | 10 | 10 | 10 | 10 | 100 | 100 | 10 | 10 | 10 |
| 5 | 10 | 10 | 10 | 10 | 10 | 100 | 100 | 10 | 10 | 10 |
| 6 | 10 | 10 | 10 | 10 | 10 | 100 | 100 | 10 | 10 | 10 |
| 7 | 10 | 10 | 10 | 10 | 10 | 100 | 10 | 10 | 10 | 10 |

PRELIMINARILY DETERMINED LIGHTING BRIGHTNESS AT POSITION OF C

*Fig.5C*

| | 1 | 2 | 3 | 4 | 5 | 6 | 7 | 8 | 9 | 10 |
|---|---|---|---|---|---|---|---|---|---|---|
| 1 | 2 | 2 | 2 | 2 | 2 | 2 | 2 | 2 | 2 | 2 |
| 2 | 0 | 0 | 0 | 0 | 0 | 1 | 1 | 0 | 0 | 0 |
| 3 | 0 | 0 | 0 | 0 | 0 | 1 | 1 | 0 | 0 | 0 |
| 4 | 0 | 0 | 0 | 0 | 0 | 2 | 2 | 0 | 0 | 0 |
| 5 | 0 | 0 | 0 | 0 | 0 | 2 | 1 | 0 | 0 | 0 |
| 6 | 0 | 0 | 0 | 0 | 0 | 1 | 1 | 0 | 0 | 0 |
| 7 | 0 | 0 | 0 | 0 | 0 | 1 | 0 | 0 | 0 | 0 |

*Fig.8*

| | 1 | 2 | 3 | 4 | 5 | 6 | 7 | 8 | 9 | 10 |
|---|---|---|---|---|---|---|---|---|---|---|
| 1 | 100 | 100 | 100 | 100 | 100 | 100 | 100 | 100 | 100 | 100 |
| 2 | 10 | 10 | 10 | 10 | 10 | 100 | 100 | 10 | 10 | 10 |
| 3 | 10 | 10 | 10 | 10 | 10 | 100 | 100 | 10 | 10 | 10 |
| 4 | 10 | 10 | 10 | 10 | 10 | 100 | 100 | 10 | 10 | 10 |
| 5 | 10 | 10 | 10 | 10 | 10 | 100 | 100 | 10 | 10 | 10 |
| 6 | 10 | 10 | 10 | 10 | 10 | 100 | 100 | 10 | 10 | 10 |
| 7 | 10 | 10 | 10 | 10 | 10 | 100 | 10 | 10 | 10 | 10 |

*Fig.9*

| | 1 | 2 | 3 | 4 | 5 | 6 | 7 | 8 | 9 | 10 |
|---|---|---|---|---|---|---|---|---|---|---|
| 1 | 3600 | 3600 | 3600 | 3600 | 3600 | 3600 | 3600 | 3600 | 3600 | 3600 |
| 2 | 0 | 0 | 0 | 0 | 0 | 120 | 300 | 0 | 0 | 0 |
| 3 | 0 | 0 | 0 | 0 | 0 | 1800 | 1800 | 0 | 0 | 0 |
| 4 | 0 | 0 | 0 | 0 | 0 | 3600 | 3600 | 0 | 0 | 0 |
| 5 | 0 | 0 | 0 | 0 | 0 | 3600 | 1800 | 0 | 0 | 0 |
| 6 | 0 | 0 | 0 | 0 | 0 | 1800 | 300 | 0 | 0 | 0 |
| 7 | 0 | 0 | 0 | 0 | 0 | 120 | 0 | 0 | 0 | 0 |

*Fig.12*

| | 1 | 2 | 3 | 4 | 5 | 6 | 7 | 8 | 9 | 10 |
|---|---|---|---|---|---|---|---|---|---|---|
| 1 | 1 | 1 | 1 | 1 | 1 | 1 | 1 | 1 | 1 | 1 |
| 2 | 0 | 0 | 0 | 0 | 0 | 1 | 1 | 0 | 0 | 0 |
| 3 | 0 | 0 | 0 | 0 | 0 | 1 | 1 | 0 | 0 | 0 |
| 4 | 0 | 0 | 0 | 0 | 0 | 1 | 1 | 0 | 0 | 0 |
| 5 | 0 | 0 | 0 | 0 | 0 | 1 | 1 | 0 | 0 | 0 |
| 6 | 0 | 0 | 0 | 0 | 0 | 1 | 1 | 0 | 0 | 0 |
| 7 | 0 | 0 | 0 | 0 | 0 | 1 | 0 | 0 | 0 | 0 |

*Fig.13*

| | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 |
|---|---|---|---|---|---|---|---|---|---|---|---|---|---|---|---|---|---|---|---|---|---|---|---|---|---|---|---|---|---|---|
| 1 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 2 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 3 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 4 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 5 | 0 | 0 | 0 | 0 | 0 | 0 | 0 | 0 | 0 | 0 | 0 | 0 | 0 | 0 | 0 | 0 | 0 | 120 | 120 | 120 | 120 | 0 | 0 | 0 | 0 | 0 | 0 | 0 | 0 | 0 |
| 6 | 0 | 0 | 0 | 0 | 0 | 0 | 0 | 0 | 0 | 0 | 0 | 0 | 0 | 0 | 0 | 0 | 0 | 100 | 100 | 100 | 120 | 120 | 0 | 0 | 0 | 0 | 0 | 0 | 0 | 0 |
| 7 | 0 | 0 | 0 | 0 | 0 | 0 | 0 | 0 | 0 | 0 | 0 | 0 | 0 | 0 | 0 | 0 | 0 | 100 | 100 | 100 | 100 | 100 | 0 | 0 | 0 | 0 | 0 | 0 | 0 | 0 |
| 8 | 0 | 0 | 0 | 0 | 0 | 0 | 0 | 0 | 0 | 0 | 0 | 0 | 0 | 0 | 0 | 0 | 0 | 250 | 250 | 250 | 100 | 100 | 0 | 0 | 0 | 0 | 0 | 0 | 0 | 0 |
| 9 | 0 | 0 | 0 | 0 | 0 | 0 | 0 | 0 | 0 | 0 | 0 | 0 | 0 | 0 | 0 | 0 | 0 | 250 | 250 | 250 | 250 | 250 | 0 | 0 | 0 | 0 | 0 | 0 | 0 | 0 |
| 10 | 0 | 0 | 0 | 0 | 0 | 0 | 0 | 0 | 0 | 0 | 0 | 0 | 0 | 0 | 0 | 0 | 0 | 250 | 250 | 250 | 250 | 250 | 0 | 0 | 0 | 0 | 0 | 0 | 0 | 0 |
| 11 | 0 | 0 | 0 | 0 | 0 | 0 | 0 | 0 | 0 | 0 | 0 | 0 | 0 | 0 | 0 | 0 | 0 | 250 | 250 | 250 | 250 | 250 | 0 | 0 | 0 | 0 | 0 | 0 | 0 | 0 |
| 12 | 0 | 0 | 0 | 0 | 0 | 0 | 0 | 0 | 0 | 0 | 0 | 0 | 0 | 0 | 0 | 0 | 0 | 250 | 250 | 250 | 250 | 250 | 0 | 0 | 0 | 0 | 0 | 0 | 0 | 0 |
| 13 | 0 | 0 | 0 | 0 | 0 | 0 | 0 | 0 | 0 | 0 | 0 | 0 | 0 | 0 | 0 | 0 | 0 | 250 | 250 | 250 | 250 | 250 | 0 | 0 | 0 | 0 | 0 | 0 | 0 | 0 |
| 14 | 0 | 0 | 0 | 0 | 0 | 0 | 0 | 0 | 0 | 0 | 0 | 0 | 0 | 0 | 0 | 0 | 0 | 250 | 250 | 250 | 250 | 250 | 0 | 0 | 0 | 0 | 0 | 0 | 0 | 0 |
| 15 | 0 | 0 | 0 | 0 | 0 | 0 | 0 | 0 | 0 | 0 | 0 | 0 | 0 | 0 | 0 | 0 | 0 | 100 | 100 | 100 | 100 | 100 | 0 | 0 | 0 | 0 | 0 | 0 | 0 | 0 |
| 16 | 0 | 0 | 0 | 0 | 0 | 0 | 0 | 0 | 0 | 0 | 0 | 0 | 0 | 0 | 0 | 0 | 0 | 100 | 100 | 100 | 100 | 100 | 0 | 0 | 0 | 0 | 0 | 0 | 0 | 0 |
| 17 | 0 | 0 | 0 | 0 | 0 | 0 | 0 | 0 | 0 | 0 | 0 | 0 | 0 | 0 | 0 | 0 | 0 | 100 | 100 | 100 | 100 | 100 | 0 | 0 | 0 | 0 | 0 | 0 | 0 | 0 |
| 18 | 0 | 0 | 0 | 0 | 0 | 0 | 0 | 0 | 0 | 0 | 0 | 0 | 0 | 0 | 0 | 0 | 0 | 100 | 100 | 100 | 120 | 120 | 0 | 0 | 0 | 0 | 0 | 0 | 0 | 0 |
| 19 | 0 | 0 | 0 | 0 | 0 | 0 | 0 | 0 | 0 | 0 | 0 | 0 | 0 | 0 | 0 | 0 | 0 | 120 | 120 | 120 | 0 | 0 | 0 | 0 | 0 | 0 | 0 | 0 | 0 | 0 |
| 20 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 21 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |

*Fig.15*

| | 1 | 2 | 3 | 4 | 5 | 6 | 7 | 8 | 9 | 10 |
|---|---|---|---|---|---|---|---|---|---|---|
| 1 | 0 | 0 | 0 | 0 | 0 | 0 | 0 | 0 | 0 | 0 |
| 2 | 0 | 0 | 0 | 0 | 0 | 120 | 120 | 0 | 0 | 0 |
| 3 | 0 | 0 | 0 | 0 | 0 | 250 | 250 | 0 | 0 | 0 |
| 4 | 0 | 0 | 0 | 0 | 0 | 250 | 250 | 0 | 0 | 0 |
| 5 | 0 | 0 | 0 | 0 | 0 | 250 | 250 | 0 | 0 | 0 |
| 6 | 0 | 0 | 0 | 0 | 0 | 100 | 120 | 0 | 0 | 0 |
| 7 | 0 | 0 | 0 | 0 | 0 | 120 | 0 | 0 | 0 | 0 |

*Fig.16*

| | 1 | 2 | 3 | 4 | 5 | 6 | 7 | 8 | 9 | 10 |
|---|---|---|---|---|---|---|---|---|---|---|
| 1 | 0 | 0 | 0 | 0 | 0 | 0 | 0 | 0 | 0 | 0 |
| 2 | 0 | 0 | 0 | 0 | 0 | 1 | 1 | 0 | 0 | 0 |
| 3 | 0 | 0 | 0 | 0 | 0 | 1 | 1 | 0 | 0 | 0 |
| 4 | 0 | 0 | 0 | 0 | 0 | 1 | 1 | 0 | 0 | 0 |
| 5 | 0 | 0 | 0 | 0 | 0 | 1 | 1 | 0 | 0 | 0 |
| 6 | 0 | 0 | 0 | 0 | 0 | 1 | 1 | 0 | 0 | 0 |
| 7 | 0 | 0 | 0 | 0 | 0 | 1 | 0 | 0 | 0 | 0 |

*Fig.17*

TOMOSYNTHESIS IMAGE

| | 1 | 2 | 3 | 4 | 5 | 6 | 7 | 8 | 9 | 10 |
|---|---|---|---|---|---|---|---|---|---|---|
| 1 | 3600 | 3600 | 3600 | 3600 | 3600 | 3600 | 3600 | 3600 | 3600 | 3600 |
| 2 | 0 | 0 | 0 | 0 | 0 | 120 | 300 | 0 | 0 | 0 |
| 3 | 0 | 0 | 0 | 0 | 0 | 1800 | 1800 | 0 | 0 | 0 |
| 4 | 0 | 0 | 500 | 0 | 0 | 3600 | 3600 | 0 | 0 | 0 |
| 5 | 0 | 0 | 0 | 0 | 0 | 3600 | 1800 | 0 | 0 | 0 |
| 6 | 0 | 0 | 0 | 0 | 0 | 1800 | 300 | 0 | 0 | 0 |
| 7 | 0 | 0 | 0 | 0 | 0 | 120 | 0 | 0 | 0 | 0 |

*Fig.20*

| | 1 | 2 | 3 | 4 | 5 | 6 | 7 | 8 | 9 | 10 |
|---|---|---|---|---|---|---|---|---|---|---|
| 1 | 1 | 1 | 1 | 1 | 1 | 1 | 1 | 1 | 1 | 1 |
| 2 | 0 | 0 | 0 | 0 | 0 | 1 | 1 | 0 | 0 | 0 |
| 3 | 0 | 0 | 0 | 0 | 0 | 1 | 1 | 0 | 0 | 0 |
| 4 | 0 | 0 | 1 | 0 | 0 | 1 | 1 | 0 | 0 | 0 |
| 5 | 0 | 0 | 0 | 0 | 0 | 1 | 1 | 0 | 0 | 0 |
| 6 | 0 | 0 | 0 | 0 | 0 | 1 | 1 | 0 | 0 | 0 |
| 7 | 0 | 0 | 0 | 0 | 0 | 1 | 0 | 0 | 0 | 0 |

*Fig.21*

IMAGE DISPLAY APPARATUS AND CONTROL METHOD THEREFOR

BACKGROUND OF THE INVENTION

1. Field of the Invention

The present invention relates to an image display apparatus and a control method therefor.

2. Description of the Related Art

In the past, in an image display apparatus using a liquid crystal device, there has been a technology in which a backlight is divided into a plurality of blocks, so that the brightness of the backlight and the transmittance of a liquid crystal are controlled based on an image signal for each block. As a result of this, the black floating (misadjusted black level) of a dark portion of an image is suppressed, and contrast is improved (for example, Japanese patent No. 3523170). Medical images represented by those taken by Roentgen or X rays, etc., are images in each of which a bright diagnostic image is disposed in a dark background, and in cases where such imaged are displayed by a liquid crystal display device, misadjusted black level may be visually recognized as disturbance. Accordingly, the disturbance of the black floating can be improved by reducing the backlight brightness of the dark portion of the image, by using the technology of the Japanese patent No. 3523170.

In addition, it is known that when the brightness of the backlight is changed rapidly, a flicker occurs, and so, there has been proposed a technology of alleviating a change in brightness of the backlight in order to reduce the flicker (for example, Japanese patent laid-open publication No. 2009-181075).

SUMMARY OF THE INVENTION

In recent years, with medical images represented such as by mammography, etc., there has been known a technology in which an object to be observed is photographed from a plurality of directions, and a diagnostic image (referred to as a tomosynthesis image) is reconstructed which displays the object to be observed in three dimensional manner from the plurality of images thus obtained. With this technology, diagnostic imaging or image diagnosis is carried out by rotating an image of a solidified or stereoscopic object to be observed in a periodic manner, or in a free manner by a diagnostic person. However, in cases where the image to be observed in the stereoscopically displayed diagnostic image is caused to rotate, a block where the image to be observed exists in the diagnostic image is not always the same. That is, the position where a bright image to be observed exists in a dark background image may be changed according to the periodic rotation of the image to be observed or by the rotation operation of an observer.

For that reason, when the technology of reducing the backlight brightness according to the display image for each block is applied, as in the Japanese patent No. 3523170, a block where a state of the backlight being lit dark and a state of the backlight being lit bright are alternately repeated will appear according to a change in the position of a bright image to be observed. In that block, there will occur flicker. In contrast to that, flicker can be reduced by alleviating or easing the brightness change of the backlight, as in the Japanese patent laid-open publication No. 2009-181075. However, when the brightness change of the backlight changes slowly in a time direction, a backlight brightness required for displaying (reproducing) the gradation (gray level) of the image in a faithful manner will not be obtained for several frames during which such a slow change is carried out. This becomes a problem particularly in the display of medical imaging in which high accuracy in the reproduction of gradation is required.

Accordingly, the present invention is intended to satisfy both high accuracy in the reproduction of gradation and reduction of flicker, in an image display apparatus which is capable of locally adjusting the brightness of a backlight based on an image.

A first aspect of the present invention resides in an image display apparatus which comprises:

a light emitting unit composed of a plurality of light emitting blocks, the brightnesses of which are able to be adjusted individually;

a display unit configured to display an image by modulating light from the light emitting unit; and a decision unit configured to divide a frame image into a plurality of divided areas, to determine whether each of the divided areas is a first region including a predetermined object or a second region not including the predetermined object, and to decide a brightness of each light emitting block based on a result of the determination of each divided area;

wherein in cases where a divided area determined as the second region in a target frame for which brightnesses are to be decided has been determined as the first region in frames, which satisfy a predetermined condition, among past frames which precede the target frame, the decision unit decides the brightness of a light emitting block corresponding to the divided area to a brightness closer to the brightness of a light emitting block corresponding to a divided area determined as the first region as compared to the brightnesses of light emitting blocks corresponding to the other divided areas determined as the second region.

A second aspect of the present invention resides in a control method for an image display apparatus which includes:

a light emitting unit composed of a plurality of light emitting blocks, the brightnesses of which are able to be adjusted individually from one another; and a display unit configured to display an image by modulating light from the light emitting unit;

the method comprising:

dividing a frame image into a plurality of divided areas, determining whether each of the divided areas is a first region including a predetermined object or a second region not including the predetermined object, and deciding a brightness of each light emitting block based on a result of the determination of each divided area;

wherein in the deciding, in cases where a divided area determined as the second region in a target frame for which brightnesses are to be decided has been determined as the first region in frames, which satisfy a predetermined condition, among past frames which precede the target frame, the brightness of a light emitting block corresponding to the divided area is decided to a brightness closer to the brightness of a light emitting block corresponding to a divided area determined as the first region as compared to the brightnesses of light emitting blocks corresponding to the other divided areas determined as the second region.

According to the present invention, in an image display apparatus which is capable of locally adjusting backlight brightness based on an image, it is possible to satisfy both high accuracy in the reproduction of gradation and reduction of flicker.

Further features of the present invention will become apparent from the following description of exemplary embodiments with reference to the attached drawings.

BRIEF DESCRIPTION OF THE DRAWINGS

FIG. 3A through FIG. 3C are examples of a characteristic amount obtained for each area in the first embodiment.

FIG. 4A through FIG. 4C are examples of a determination result for each area in the first embodiment.

FIG. 5A through FIG. 5C are examples of a lighting brightness for each area in the first embodiment.

FIG. 8 is an example of a determination result of periodicity in each area in the first embodiment.

FIG. 9 is an example of a final lighting brightness in each area in the first embodiment.

FIG. 12 is an example of a calculation result of a determination area result addition unit in the second embodiment.

FIG. 13 is an example of a determination result in each area of a periodicity determination unit in the second embodiment.

FIG. 15 is an example of a calculation result of a moving vector change detection addition unit according to the third embodiment.

FIG. 16 is an example of a conversion result of an individual area change amount conversion unit according to the third embodiment.

FIG. 17 is an example of a determination result of a periodicity determination unit in the third embodiment.

FIG. 20 is an example of a calculation result of a determination area result addition unit in the fourth embodiment.

FIG. 21 is an example of a determination result in each area of a periodicity determination unit in the fourth embodiment.

DESCRIPTION OF THE EMBODIMENTS

First Embodiment

Hereinafter, reference will be made to preferred embodiments of the present invention, while referring to the attached drawings.

In a first embodiment, a screen is divided into a plurality of areas, a statistic value is obtained for each of the divided areas, and from the statistic values thus obtained, a diagnostic region and a background region in an input image are determined for each of the divided areas. A determination result for each of the divided areas is stored in a plurality of frames, so that an area always determined as the diagnostic region and an area periodically determined as the diagnostic region (i.e., a determination called the diagnostic region and a determination called the background region vary in a periodic manner) are detected. For an area periodically determined as the diagnostic region, the backlight is made to light with the same brightness as when it is determined as the diagnostic region, without regard to a determination result for each frame. According to this, it is possible to satisfy both reproducibility of gradation and reduction of flicker. Hereinafter, this will be explained in detail.

Figure 1:
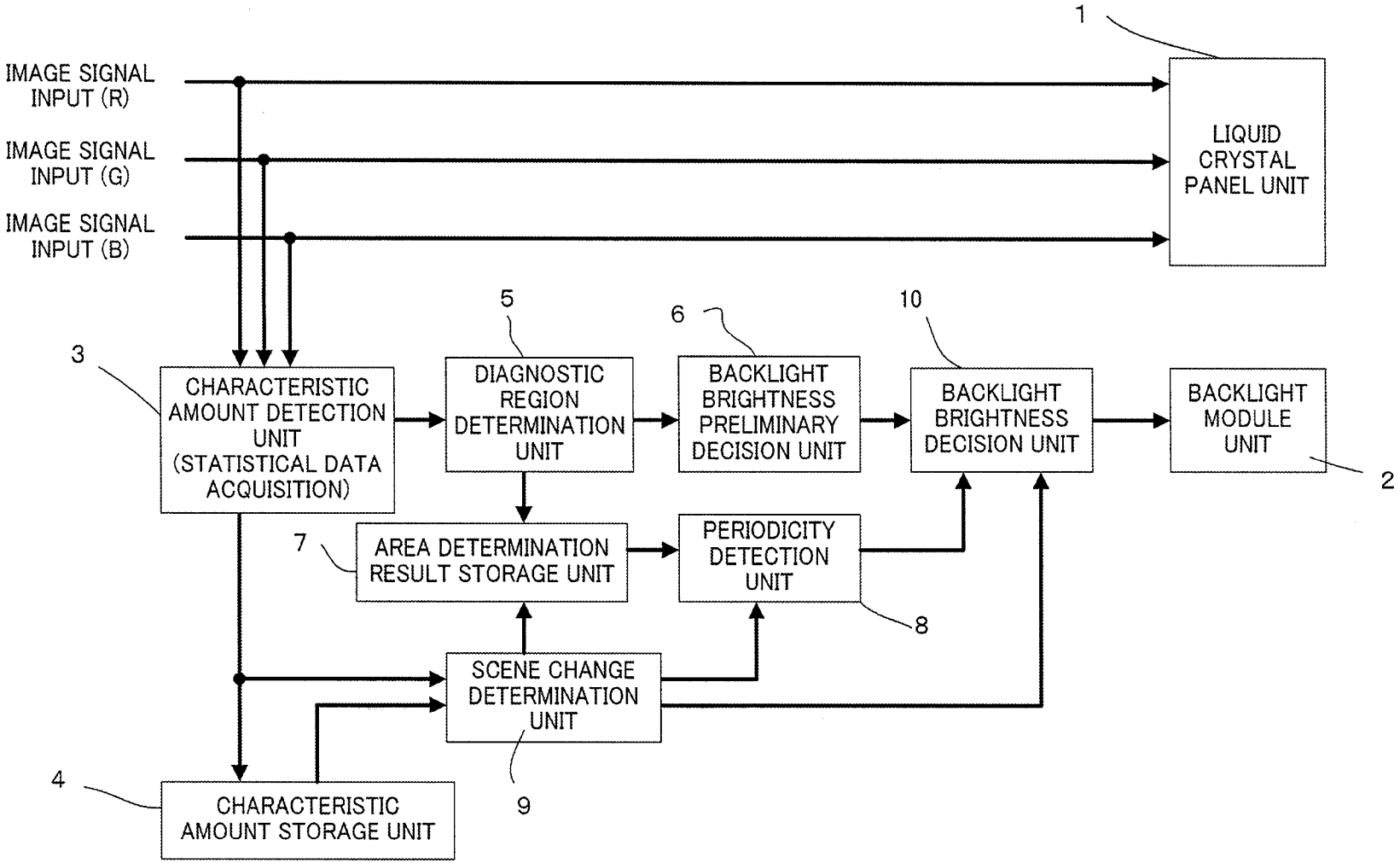
FIG. 1 is a functional block diagram of an image display apparatus according to a first embodiment of the present invention.

FIG. 1 shows a functional block diagram of an image display apparatus in a first embodiment of the present invention. As shown in FIG. 1, the image display apparatus of this embodiment is composed of a liquid crystal panel unit 1, a backlight module unit 2, a characteristic amount detection unit 3, a characteristic amount storage unit 4, a diagnostic region determination unit 5, a backlight brightness preliminary decision unit 6, an area determination result storage unit 7, a periodicity detection unit 8, a scene change determination unit 9, and a backlight brightness decision unit 10.

The liquid crystal panel unit 1 has a liquid crystal driver, a control board which is configured to control the liquid crystal driver in response to an input image signal, and a liquid crystal panel. The liquid crystal panel is a display panel which serves to display an image based on the image signal (image data) by modulating light from a backlight based on the image signal (image data).

The backlight module unit 2 has a light source for the backlight, a control circuit for controlling the light source, and an optical unit for diffusing light from the light source. The backlight is divided into a plurality of light emitting blocks the brightnesses of which can be adjusted individually, so that the brightness or luminous intensity for each light emitting block can be controlled independently from one another. The light emitting blocks are each composed of one or a plurality of light sources (e.g., light emitting diodes). The number of divisions of the blocks is taken as m in a transverse or horizontal direction and n in a longitudinal or vertical direction (m and n are integers). In this embodiment, reference will be made, by way of example, to a case where the backlight is divided into blocks of 10 (in the transverse direction)×7 (in the longitudinal direction). The backlight module unit 2 receives a control value decided by the backlight brightness decision unit 10, and turns on the backlight based on this control value.

In the characteristic amount detection unit 3, a frame image based on the input image signal is divided into areas which correspond to individual blocks of the backlight, and a characteristic amount for each of the divided areas is detected. The characteristic amount detection unit 3 transmits the characteristic quantities thus detected to the characteristic amount storage unit 4, the diagnostic region determination unit 5, and the scene change determination unit 9. In this embodiment, the characteristic amount detection unit 3 detects a maximum value of an RGB signal for each of the divided areas. A case where an input image is one as shown in FIG. 2 will be explained by way of example.

Figure 2:
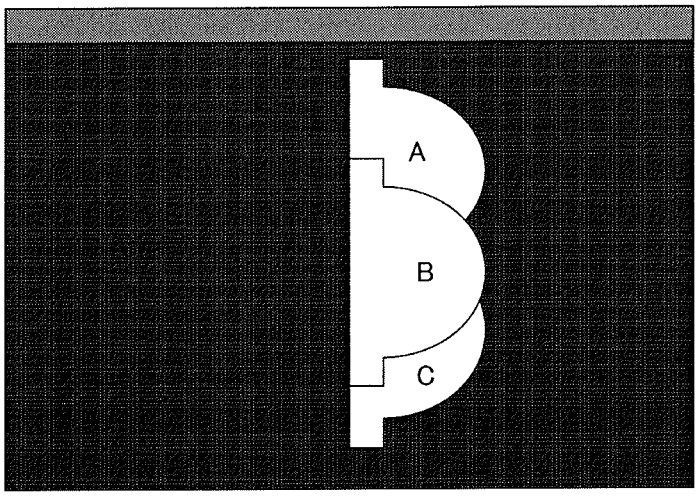
FIG. 2 is an example of input image data in the first embodiment.

As shown in FIG. 2, an image to be inputted is one in which a bright attention image of an object (an object to be observed or observation object) is arranged in a black background image. In FIG. 2, how positions (A, B, C) of an object image in three sheets of different frame images inputted at different timings, respectively, vary or move in a vertical direction on a screen is conceptually shown in one sheet of image. In cases where the object image exists in the position of A in the screen, it is shown that the object image exists in the uppermost position on the screen. On the contrary, the position of C shows that the object image exists in the lowermost position on the screen. Then, the position of B shows that the object image exists substantially in a central position of an area in which the position of the object image varies.

The maximum values (maximum pixel values) of the RGB signals, which are characteristic quantities of individual blocks at the time when three kinds of images shown in FIG. 2 are inputted, are shown in FIGS. 3A through 3C, respectively. Numerical values in the individual divided areas shown by grids in FIGS. 3A through 3C represent the maximum values of the RGB signals in the individual divided areas which are obtained by the characteristic amount detection unit 3. In addition, numerical values 1-10 in the horizontal direction and numerical values 1-7 in the vertical direction shown on outer sides of an outermost grid represent horizontal coordinates and vertical coordinates for specifying the position of each of the divided areas, respectively. FIG. 3A, FIG. 3B and FIG. 3C show the characteristic quantities (maximum values of RGB signals) of individual blocks when the object image is in the positions of A, B and C in FIG. 2, respectively. For example, when the object image is in the position of A, the bright object image exists in a divided area corresponding to a block of coordinates (6, 2) shown in FIG. 3A, and so, the characteristic amount of the block of coordinates (6, 2) is 160. However, in cases where the object image is in the positions of B, C, the object image does not exist in the divided area corresponding to the block of coordinates (6, 2), and so, the characteristic amount of the block of coordinates (6, 2) becomes "0", as shown in FIG. 3B and FIG. 3C. The characteristic amount detection unit 3 transmits the characteristic amount (maximum value of an RGB signal) for each of the divided areas of the input image obtained in this manner to the characteristic amount storage unit 4 and the diagnostic region determination unit 5.

The characteristic amount storage unit 4 stores a maximum value of each divided area detected one frame before by the characteristic amount detection unit 3, and outputs it to the scene change determination unit 9.

In the diagnostic region determination unit 5, it is determined for each divided area whether an image based on the input image signal is a divided area of concern which includes an image of concern in a frame image or a background divided area which do not include the image of concern in the frame image. In this embodiment, the divided area of concern is a divided area where a diagnostic image is included, and is referred to as a diagnostic region. The background divided area is a divided area where the diagnostic image is not included, and is referred to as a background region. The background region is an area where a background image is displayed, and the diagnostic region is an area where the object image of the observation object is displayed. Specifically, the diagnostic region determination unit 5 makes a determination of the diagnostic region by carrying out a comparison between the maximum value of each divided area obtained by the characteristic amount detection unit 3 at a preceding stage, and a threshold value set in advance. In this embodiment, the threshold value is set to 10, and the diagnostic region determination unit 5 determines that a divided area of which the maximum value is equal to or more than 10 is the diagnostic region, and determines that a block of which the maximum value is smaller than 10 is the background region. The diagnostic region determination unit 5 outputs a result of the determination of each divided area. The diagnostic region determination unit 5 quantifies as "1" the value of the divided area determined as the diagnostic region, and as "0" the value of the divided area determined as the background region, and outputs the determination results.

In cases where the object image is in the positions of A, B and C in FIG. 2, respectively, the determination results come to be shown in FIG. 4A, FIG. 4B and FIG. 4C, respectively, based on the acquisition results of the maximum values shown in FIG. 3A, FIG. 3B and FIG. 3C. When the object is in the position of A in the image of FIG. 2, the maximum value of the divided area of coordinates (6, 2) is 160, as seen from FIG. 3A, and hence is equal to or more than the threshold value of 10, so that the object is determined to be in the diagnostic region. On the other hand, when the object is in the position of B or C, the maximum value of the divided area of coordinates (6, 2) is "0", as seen from FIG. 3 (*b*) and FIG. 3C, and hence is smaller than the threshold value of 10, so that the object is determined to be in the background region. The diagnostic region determination unit 5 transmits the determination result (the result of the determination of the diagnostic region) thus obtained as to whether each divided area is the background region or the diagnostic region to the backlight brightness preliminary decision unit 6 and the area determination result storage unit 7 at the following or later stage.

The backlight brightness preliminary decision unit 6 makes a preliminary decision on the lighting brightness of the backlight from the diagnostic region determination result obtained from the diagnostic region determination unit 5. In this embodiment, the lighting brightness in the case of turning on the backlight at the highest brightness at which the backlight can be lit is set to 100, wherein a block corresponding to the diagnostic region is lit at a lighting brightness of 100 and a block corresponding to the background region is lit at a lighting brightness of 10.

The lighting brightnesses of the backlight preliminarily decided at the time when the object is in the positions of A, B and C in FIG. 2, respectively, are shown in FIG. 5A, FIG. 5B and FIG. 5C, respectively. In the case where the object is in the position of A, the diagnostic region determination result of the divided area of coordinates (6, 2) is "1", which represents the diagnostic region, as shown in FIG. 4A, and hence, the backlight brightness preliminary decision unit 6 preliminarily decides the lighting brightness of the block corresponding to the divided area of coordinates (6, 2) as 100. On the other hand, in the case where the object is in the position of B or C, the diagnostic region determination result of the divided area of coordinates (6, 2) is "0", which represents the background region, as shown in FIG. 4B or FIG. 4C. Accordingly, the backlight brightness preliminary decision unit 6 preliminarily decides the lighting brightness of the block corresponding to the divided area of coordinates (6, 2) as 10. The backlight brightness preliminary decision unit 6 transmits the lighting brightness of the backlight for each block preliminarily decided in this manner to the backlight brightness decision unit 10 at the following stage.

The area determination result storage unit 7 stores the diagnostic region determination results obtained by the diagnostic region determination unit 5. In this embodiment, the area determination result storage unit 7 stores the diagnostic region determination results for 60 seconds. In the case where the frequency of a display is 60 Hz, the diagnostic region determination results to be stored become 60 (seconds)×60 frames=3,600 frames. The area determination result storage unit 7 holds the diagnostic region determination results obtained from the diagnostic region determination unit 5 for the 3,600 frames. In cases where the diagnostic region determination results thus obtained exceed 3,600 frames, the area determination result storage unit 7 deletes the diagnostic region determination result of the oldest frame previously obtained, and stores the diagnostic region determination result of a newly obtained frame. The area determination result storage unit 7 transmits diagnostic region determination results for a plurality of frames stored in this manner to the periodicity detection unit 8. Here, note that the area determination result storage unit 7 deletes the diagnostic region determination results of all the frames currently held, at the time when information of a scene change is received from the scene change determination unit 9. That is, the area determination result storage unit 7 stores the diagnostic region determination results for a predetermined number of latest or most recent frame images from the last detected scene change to the present time.

The periodicity detection unit 8 determines, from the diagnostic region determination results for the plurality of frames received from the area determination result storage unit 7, whether each divided area is which one of three kinds of regions including (1) a constant (or continuous) diagnostic region, (2) a constant (or continuous) background region, and (3) a periodical diagnostic region. The periodicity detection unit 8 detects the periodic diagnostic region. A method for detection will be explained by using a flow chart in FIG. 6.

Figure 6:
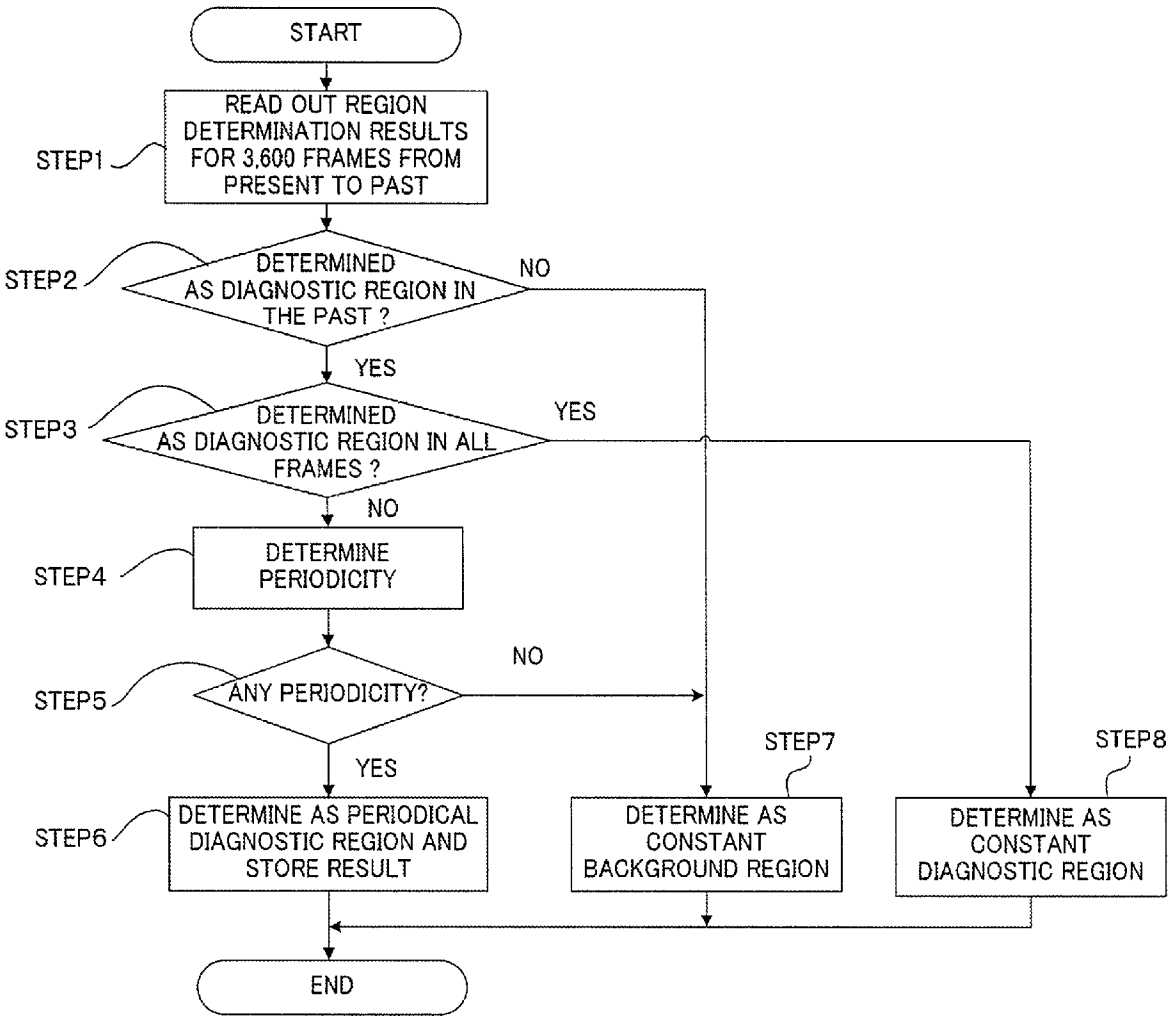
FIG. 6 is a determination flow chart diagram of periodicity of a periodicity detection unit according to the first embodiment.

In step 1 in FIG. 6, the periodicity detection unit 8 reads out diagnostic region determination results of divided areas to be determined from the area determination result storage unit 7, and shifts to the following step 2. In this embodiment, the periodicity detection unit 8 reads out diagnostic region determination results for 3,600 frames from the past to the present.

In step 2, the periodicity detection unit 8 determines whether a divided area to be determined has been a diagnostic region even once in the diagnostic region determination results for the plurality of frames read out in step 1. In cases where a divided area to be determined has been a diagnostic region, the processing in the periodicity detection unit 8 shifts to step 3, whereas in cases where a divided area to be determined has not been a diagnostic region even once, the periodicity detection unit 8 shifts to step 7. In the diagnostic region determination results outputted from the diagnostic region determination unit 5, "1" is outputted in the case of a diagnostic region, and "0" is outputted in the case of a background region. Accordingly, in cases where there is at least one frame of which the value of a diagnostic region determination result is "1" in the diagnostic region determination results for the plurality of frames read out in step 1, it is judged that a divided area corresponding to the diagnostic region determination result of "1" has been determined as a diagnostic region, and the processing shifts to step 3.

In step 3, the periodicity detection unit 8 determines whether the divided area to be determined has been a diagnostic region, in all the diagnostic region determination results for the plurality of frames readout in step 1. In a case where that divided area has been a diagnostic region in all the frames, the processing in the periodicity detection unit 8 shifts to step 8. In the other cases (i.e., in cases where that divided area has been a background region in at least one frame), the processing in the periodicity detection unit 8 shifts to step 4. In the diagnostic region determination results for the plurality of frames read out in step 1, in a case where there is at least one frame of which the value of the diagnostic region determination result is "0", it is judged that a divided area corresponding to the diagnostic region determination result of "0" has not been determined as a diagnostic region in all the frames, and the processing shifts to step 4.

In step 4, the periodicity detection unit 8 determines whether a predetermined condition is satisfied for the divided area which has been determined as a diagnostic region in a part of the plurality of frames, in the diagnostic region determination results for the plurality of frames readout in step 1. In this embodiment, as the predetermined condition, the periodicity detection unit 8 determines whether a change between the background region and the diagnostic region has a periodicity. Specifically, the periodicity detection unit 8 detects a frame in which the diagnostic region determination result of a divided area to be determined changes from a background region to a diagnostic region, and determines whether there are a plurality of such frames. In cases where there are a plurality of such frames, a difference in frame number (frame difference number) between the detected frames is obtained. A frame difference number represents a time interval between the frames. In cases where the frame difference number falls within a predetermined range for all the detected changes from a background region to a diagnostic region, the periodicity detection unit 8 makes a determination that there is a periodicity in the change between the background region and the diagnostic region.

On the other hand, even in cases where the frame difference number does not fall within the above-mentioned range (i.e., the frame difference number is random), when the number of frames in which a change occurs from a background region to a diagnostic region is equal to or larger than a predetermined number, the periodicity detection unit 8 makes a determination that there is a periodicity in changes between the background region and the diagnostic region. In this embodiment, in cases where the amplitude of the variation of the frame difference number is within 10% (i.e., the ratio of an amount of variation with respect to a central value of a variation range is less than plus or minus 10%), or in cases where the change from the background region to the diagnostic region occurs three times or more, the periodicity detection unit 8 makes a determination that the change between the background region and the diagnostic region has a periodicity.

Figure 7:
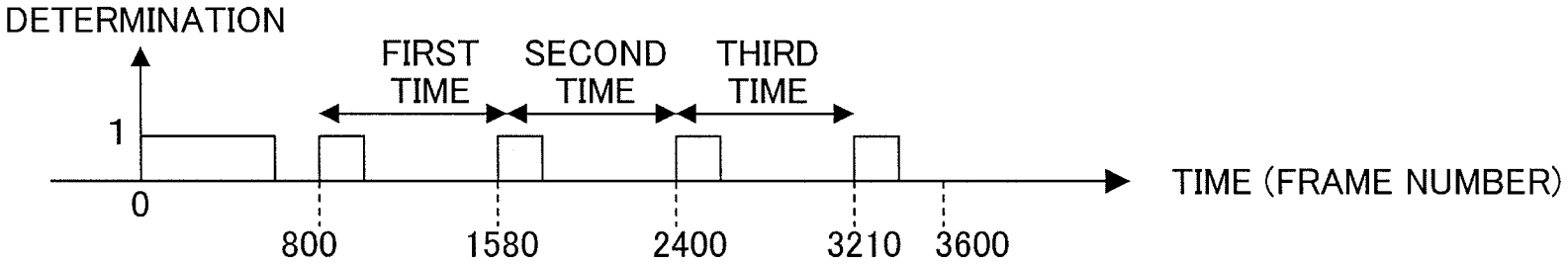
FIG. 7 is an example of temporal changes of results of diagnostic area determinations of blocks in the first embodiment.

An example of the determination of the periodicity will be explained by the use of FIG. 7. FIG. 7 shows a change over time of the diagnostic region determination results for the 3,600 frames of a certain divided area along time course (frame number). The axis of abscissa represents a time base (frame number), and the axis of ordinate represents the determination results, wherein "1" indicates a diagnostic region and "0" indicates a background region. Numerical values under the time base represent frame numbers. In the example of FIG. 7, a frame of which the diagnostic region determination result first changes from the background region "0" to the diagnostic region "1" is an 800th frame. Then, a frame of which the diagnostic region determination result next changes from "0" to "1" is a 1,580th frame. Thereafter, frames of which the diagnostic region determination results change from "0" to "1" are a 2,400th frame and a 3,210th frame.

In the example of FIG. 7, the frame difference numbers between the frames which change from the background region to the diagnostic region are between 780 and 820. A central value of the variation range is 800, and the amount of variation is within 20 frames from the central value, and hence, the amplitude of the variation is less than plus or minus 2.5%, so that the amplitude of the variation of the frame difference numbers falls within the threshold value of 10. In this embodiment, in cases where the amplitude of the variation is within 10%, or in cases where the change from the background region to the diagnostic region occurs three times or more, it is determined that there exists a periodicity, as a result of which this divided area is determined as a divided area which changes between the diagnostic region and the background region in a periodic manner. After the determination in step 4 as mentioned above, the processing shifts to step 5.

In step 5, the periodicity detection unit 8 determines whether the determination result in step 4 has "a periodicity" or "no periodicity". In cases where the periodicity detection unit 8 determines that the determination result in step 4 has "a periodicity", the processing shifts to step 6, whereas in cases where it is determined otherwise (i.e., "no periodicity"), the processing shifts to step 7.

In step 6, the periodicity detection unit 8 decides that the divided area to be determined is a divided area (periodical diagnostic region) which alternately becomes the diagnostic region and the background region in a periodic manner, and stores the result of such a decision.

In step 7, the periodicity detection unit 8 decides that the divided area to be determined is a divided area (i.e., a constant or continuous background region) which is always (constantly or continuously) the background region. In the case of this embodiment, in the diagnostic region determination results for the plurality of frames read out in step 1, a divided area, which has not been the diagnostic region even once, and a divided area, which has been the diagnostic region but is determined to have no periodicity, are each determined as a constant or continuous background region.

In step 8, the periodicity detection unit 8 decides that the divided area to be determined is a divided area (i.e., a constant or continuous diagnostic region) which is always (constantly or continuously) the diagnostic region. In this embodiment, in the diagnostic region determination results for the plurality of frames read out in step 1, a divided area, which has been the diagnostic region in all the results (YES in step 3), is determined as a constant or continuous diagnostic region.

The periodicity detection unit 8 transmits information on the periodical diagnostic region detected as mentioned above (periodicity determination result) to the backlight brightness decision unit 10.

The periodicity determination results in the case when an image in which an object image carries out a reciprocating movement between the positions A and C indicated by the images in FIG. 2 is inputted are shown in FIG. 8. In FIG. 8, numerical values "0", "1" and "2" represent individual cases where a divided area to be diagnosed has been determined as a constant background region, a periodic diagnostic region, and a constant diagnostic region, respectively. In cases where the object image carries out the reciprocating movement between the positions A and C in FIG. 2, a central portion of the screen in which the object image always exists is determined as a constant diagnostic region, and peripheral portions of the object image are determined as periodic diagnostic regions. In addition, in an upper region in the images of FIG. 2, there is an area where a GUI (graphical user interface) (e.g., a tool bar) of a diagnostic image display application is displayed, and this area is also determined as a constant diagnostic image. For that reason, the divided areas of the upper region of the screen are all determined as constant diagnostic images. The periodicity determination results obtained by the periodicity detection unit 8 are stored until the periodicity detection unit 8 is notified of the occurrence of a scene change from the scene change determination unit 9.

The scene change determination unit 9 determines whether there has been any scene change, from a characteristic amount of a current frame detected by the characteristic amount detection unit 3 and a previous characteristic amount one frame before stored in the characteristic amount storage unit. In this embodiment, in cases where a change in a brightness average value of the entire screen is equal to or greater than a threshold value set in advance, the scene change determination unit 9 makes a determination that a scene change has occurred. The scene change determination unit 9 sends the result of the scene change determination to the area determination result storage unit 7, the periodicity detection unit 8, and the backlight brightness decision unit 10.

In the backlight brightness decision unit 10, final lighting brightnesses of all the blocks are decided from a lighting brightness for each block preliminarily decided by the backlight brightness preliminary decision unit 6 and the periodicity determination results detected by the periodicity detection unit 8. In this embodiment, the lighting brightness of a block corresponding to a periodical diagnostic region and the lighting brightness of a block corresponding to a constant diagnostic region are set to be 100, and the lighting brightness of a block corresponding to a constant background region is set to be 10. In cases where the lighting brightness of a block decided by the backlight brightness decision unit 10 is different with respect to the lighting brightness of the same block preliminarily decided by the backlight brightness preliminary decision unit 6, the lighting brightness decided by the backlight brightness decision unit 10 becomes a final backlight control value.

For example, a lighting brightness of a block of coordinates (6, 6) in FIG. 5A preliminarily decided is 10 which is the brightness setting value of the background region. In the result of a periodicity determination in FIG. 8, a divided area of coordinates (6, 6), of which the numerical value is "1", is determined as a periodic diagnostic region. From this, the backlight brightness decision unit 10 changes the lighting brightness of the block of coordinates (6, 6) to 100. On the other hand, in the periodicity determination results, the divided area of coordinates (6, 2) is determined as a periodical diagnostic region, but the brightness thereof preliminarily decided is 100, so the backlight brightness decision unit 10 does not change the lighting brightness at coordinates (6, 2) from the thus preliminarily decided lighting brightness. In this manner, the backlight brightness decision unit 10 corrects the lighting brightness of a block set as a dark lighting brightness in the preliminary decision to a bright lighting brightness, based on the periodicity determination results. The lighting brightness for each block decided by the backlight brightness decision unit 10 is shown in FIG. 9. The backlight brightness decision unit 10 transmits the thus decided lighting brightness for each block to the backlight module unit 2.

Figure 10:
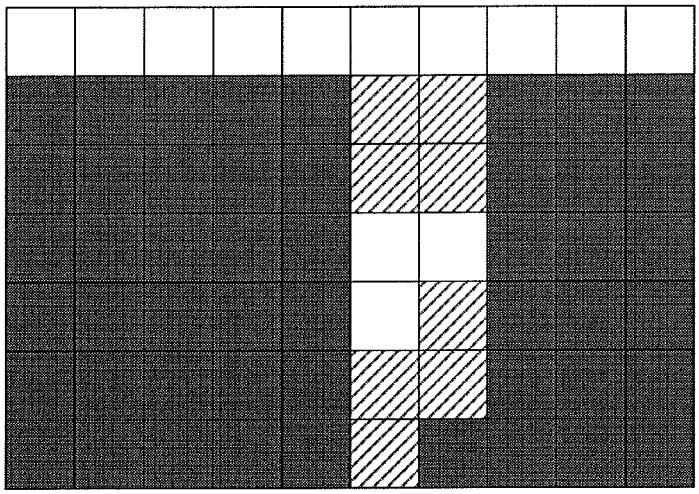
FIG. 10 is an image of a lighting result in each area of the backlight in the first embodiment.

Now, operational effects or advantages of this embodiment will be explained below while using FIG. 10. FIG. 10 is a view showing the periodicity determination results of FIG. 8, wherein white divided areas represent divided areas which have been determined as constant diagnostic images; gray divided areas represent divided areas which have been determined as constant background regions; and shaded (hatched) divided areas represent divided area which have been determined as periodical diagnostic regions. A block corresponding to a hatched divided area is conventionally a block in which the lighting of a brightness of 100 at the time when an image in the divided area is in a diagnostic region and the lighting of a brightness of 10 at the time when an image in the divided area is in a background region are repeated in a display period of a plurality of frames (e.g., 3,600 frames in FIG. 7).

However, in this embodiment, a hatched divided area is determined as a periodical diagnostic region, so that when an image in the divided area is in a diagnostic region, or when an image in the divided area is in a background region, too, the lighting of the divided area is carried out at a brightness of 100. Accordingly, in the display period of the plurality of frames (e.g., 3,600 frames in FIG. 7), the brightness of the divided area does not change in a periodic manner, so flicker is suppressed. Further, when the image in the divided area is in the diagnostic region, the lighting brightness of a block corresponding to the divided area does not become lower than a lighting brightness of 100 which corresponds to that in the diagnostic region, and hence, high reproducibility of gradation can be maintained. Accordingly, even in cases where an image is inputted in which the position of a bright object image varies in a dark background image is inputted, as shown in FIG. 2, it is possible to satisfy both the suppression of flicker and high reproducibility of gradation.

Here, note that in this embodiment, periodicity is determined from the diagnostic region determination results, but periodicity may instead be determined from a change over time in the statistics of each divided area, or in the preliminary brightness for each block of the backlight. In this embodiment, there has been explained an example in which in cases where a divided area determined as a background region (a second region) in a target frame for which brightnesses are to be decided has been determined as a diagnostic region (a first region) in frames, which satisfy a predetermined condition, among past frames, the brightness of the divided area is made equal to a brightness for the diagnostic region. However, it may not necessarily make the brightness of a block, which corresponds to a background region in a target frame and which has been determined as a diagnostic region in past frames which satisfy the predetermined condition, equal to the brightness of a block corresponding to a diagnostic region in the target frame.

For example, the brightness of the block of concern may also be made substantially equal to the brightness of a block corresponding to a diagnostic region in the target frame (i.e., the brightness for the diagnostic region). In addition, the brightness of the block of concern may also be made higher than the brightness of a block which has not been determined as a diagnostic region and which corresponds to an ordinary background region in past frames which satisfy the predetermined condition. Moreover, the brightness of the block of concern may also be made closer to the brightness for a diagnostic region as compared to the brightness of a block corresponding to an ordinary background region. A difference between a brightness to be set for a background region which has been determined as a diagnostic region in past frames which satisfy the predetermined condition and a brightness for a diagnostic region may be made smaller than a difference between a brightness to be set for an ordinary background region and the brightness for the diagnostic region.

Or, in cases where a divided area determined as a background region (a second region) in a target frame for which brightnesses are to be decided has been determined as a diagnostic region (a first region) in past frames which satisfy a predetermined condition, the brightness of the divided area of concern may be made within a range of plus or minus 15% with respect to a brightness for a diagnostic region. In that case, there can be obtained an effect of suppressing flicker.

Further, in this embodiment, there has been explained an example in which when a divided area is detected in which a background region and a diagnostic region change with each other in a periodic manner, the lighting brightness of a block corresponding to the divided area thus detected is changed to always be a lighting brightness for the diagnostic region. In this case, however, the lighting brightnesses of the entire blocks may be changed to always be the lighting brightness for the diagnostic region. In addition, information indicating medical image data such as a tomosynthesis image, etc., may be added to metadata (additional information) of an input image, so that only in cases where the information concerned is detected, detection processing for periodical diagnostic regions may be carried out. As a result of this, in the case of no need, the detection processing for periodical diagnostic regions is not carried out, and accordingly, each block is lit with a lighting brightness based on the characteristic amount of a corresponding divided area for each frame. In this case, as explained in the above-mentioned embodiment, the lighting brightness of a block for a display image, though being a background image, does not become a bright lighting brightness for a diagnostic image, thus making it possible to prevent useless power consumption.

Second Embodiment

In the first embodiment, the blocks corresponding to the divided areas, which are determined as periodical diagnostic regions from changes in a plurality of frames of the diagnostic region determination results for each divided area, are always lit with the lighting brightness for diagnostic regions. However, in a second embodiment, the results determined as diagnostic regions are integrated, so that periodicity is determined based on the result of the integration. As a result, it becomes possible to reduce the capacity of memory in comparison with the first embodiment.

Figure 11:
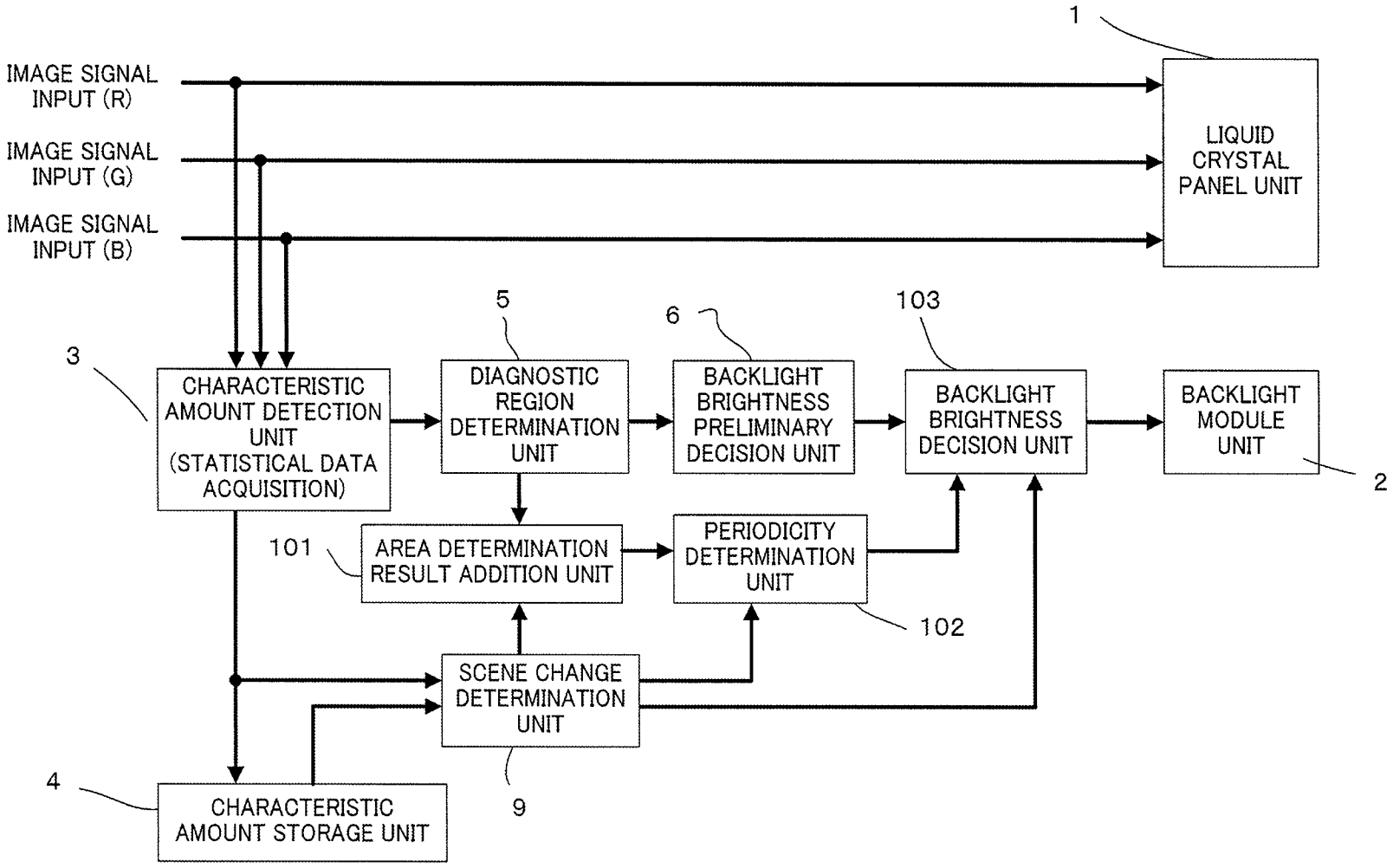
FIG. 11 is a functional block diagram of an image display apparatus according to a second embodiment of the present invention.

FIG. 11 shows a functional block diagram of an image display apparatus in a second embodiment of the present invention. As shown in FIG. 11, the image di splay apparatus of this second embodiment is composed of a liquid crystal panel unit 1, a backlight module unit 2, a characteristic amount detection unit 3, a characteristic amount storage unit 4, a diagnostic region determination unit 5, a backlight brightness preliminary decision unit 6, an area determination result addition unit 101, a periodicity determination unit 102, a scene change determination unit 9, and a backlight brightness decision unit 103.

The liquid crystal panel unit 1, the backlight module unit 2, the characteristic amount detection unit 3, the characteristic amount storage unit 4, the diagnostic region determination unit 5, the backlight brightness preliminary decision unit 6, and the scene change determination unit 9, as explained in the first embodiment, are the same as those of the first embodiment, and hence, the explanation thereof is omitted.

The area determination result addition unit 101 adds (integrates) diagnostic region determination results (numerical value of "0" or "1") for a plurality of frames obtained by the diagnostic region determination unit 5 for each divided area. Each result of the addition show the number of the frames which have been determined as diagnostic regions, in the frame images from the past to the present for each divided area. The area determination result addition unit 101 resets the results of the addition of all the divided areas to "0", at the time when it is notified of the occurrence of a scene change from the scene change determination unit 9. An example of the results of addition for each divided area is shown in FIG. 12. FIG. 12 shows the diagnostic region determination results for 3,600 frames for each divided area. From this figure, the result of addition of divided areas which are determined as constant diagnostic regions is 3600, and the result of addition of divided areas which are determined as periodical diagnostic regions disperses between 120-1,800. The result of addition of divided areas which are determined as constant background regions is "0". Here, note that an upper limit is set for the results of addition. In cases where a result of addition reaches the upper limit, the result of addition is fixed to the upper limit. The area determination result addition unit 101 transmits the results of addition thus obtained to the periodicity determination unit 102.

The periodicity determination unit 102 detects candidates of periodical diagnostic regions from the results obtained by the area determination result addition unit 101. The periodicity determination unit 102 makes a determination that a divided area for which the result of addition is equal to or larger than a threshold value is a candidate for a periodical diagnostic region. In addition, the periodicity determination unit 102 makes a determination that a divided area for which the result of addition is smaller than the threshold value is a constant background region. In this embodiment, assuming that the threshold value is set to 100, in the case of FIG. 12, it is determined that divided areas for which the results of addition are 120, 300, 1800, and 3600, respectively, are candidates for periodical diagnostic regions. That is, in the case of this embodiment, a constant diagnostic region is also determined as a periodical diagnostic region. An example of such periodicity determination results obtained by the periodicity determination unit 102 is shown in FIG. 13. In FIG. 13, candidates (divided areas) for periodical diagnostic regions are set to "1", and the other divided areas are set to "0". The periodicity determination unit 102 transmits the periodicity determination results to the backlight brightness decision unit 103.

The backlight brightness decision unit 103 decides lighting brightnesses which become final backlight control values, from lighting brightnesses preliminarily decided by the backlight brightness preliminary decision unit 6 and the periodicity determination results obtained by the periodicity determination unit 102. The backlight brightness decision unit 103 changes into a high brightness for diagnostic regions, the lighting brightnesses of the blocks corresponding to the divided areas which have been determined as candidates for periodical diagnostic regions by the periodicity determination unit 102, among those blocks of which the brightnesses have preliminarily been decided to be a low brightness for background regions by the backlight brightness preliminary decision unit 6. That is, in the lighting brightnesses preliminarily decided for each frame as shown in FIG. 5, among those blocks which have been decided to be the lighting brightness of 10 for background regions, the lighting brightnesses of the blocks corresponding to those divided areas of which the values are "1" in the periodicity determination results of FIG. 13 are changed to the lighting brightness of 100 for diagnostic regions.

In the above configuration, similar to the first embodiment, even in cases where an image is inputted in which the position of a bright object image varies in a dark background image is inputted, as shown in FIG. 2, it is possible to suppress the backlight from blinking thereby to partially or locally generate flicker. In addition, in comparison with the first embodiment, it is not necessary to store the diagnostic region determination results in a memory, thus making it possible to reduce the capacity of the memory necessary for control.

Third Embodiment

In the second embodiment, candidates for periodical diagnostic regions are determined from the diagnostic region determination results, but in a third embodiment, they are determined by the use of moving or motion vectors. That is, moving vectors are obtained, and blocks in which the direction and/or the magnitude of a moving vector changes in a periodic manner are detected. Thus, by counting the number of frames in which the direction and/or the magnitude of a moving vector changes, candidates for periodical diagnostic regions are detected. Then, similar to the first and second embodiments, among those blocks of which the lighting brightnesses preliminarily decided are a low lighting brightness for background regions, the brightnesses of the blocks corresponding to the divided areas determined as the candidates for periodical diagnostic regions are changed into a high lighting brightness for diagnostic regions. As a result of this, similar to the first and second embodiments, it is possible to satisfy both the suppression of flicker and high reproducibility of gradation. Also, by using the moving vectors, in dynamic or moving images in which characters or large objects on a screen go in a fixed direction, candidates for periodical diagnostic regions can be detected, whereby it is possible to satisfy both the suppression of flicker and high reproducibility of gradation.

Figure 14:
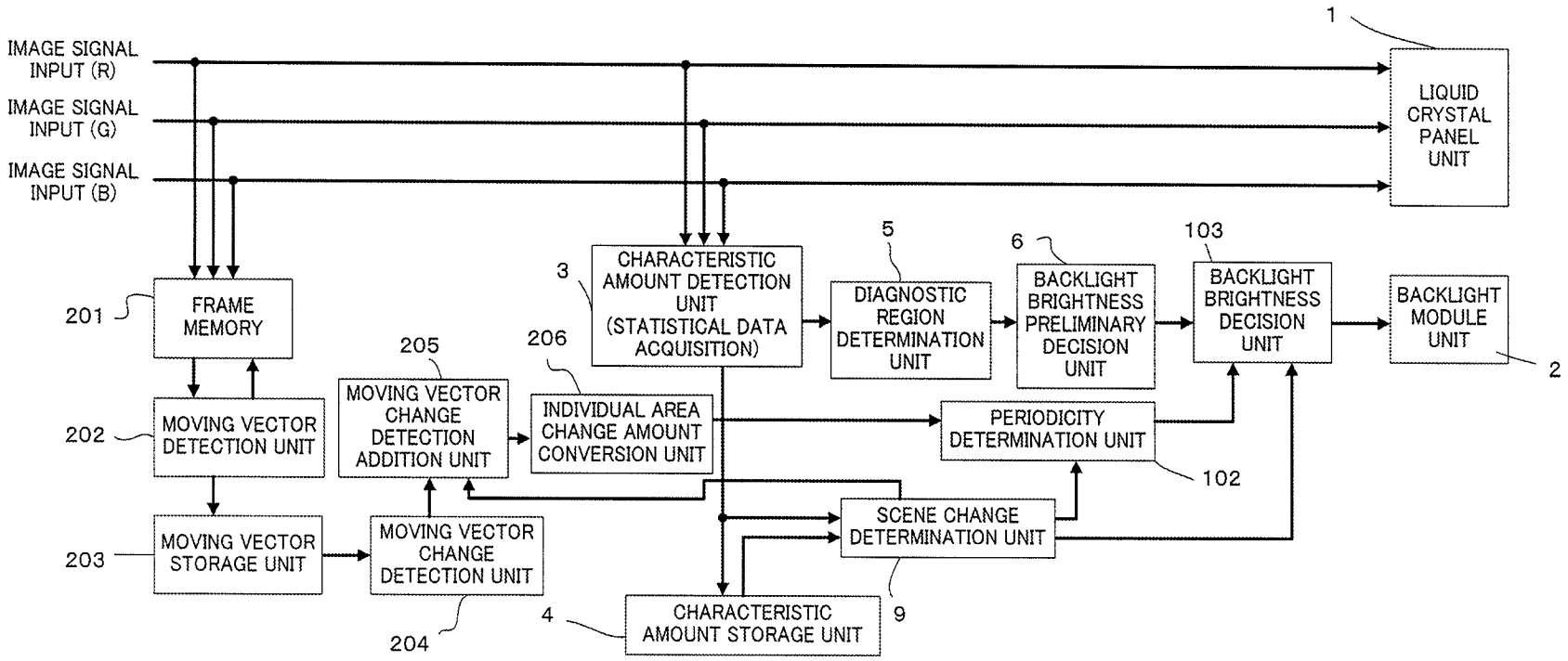
FIG. 14 is a functional block diagram of an image display apparatus according to a third embodiment of the present invention.

FIG. 14 shows a functional block diagram of an image display apparatus in the third embodiment of the present invention. As shown in FIG. 14, the image di splay apparatus of this embodiment is composed of a liquid crystal panel unit 1, a backlight module unit 2, a frame memory 201, a moving vector detection unit 202, a moving vector storage unit 203, a moving vector change detection unit 204, a moving vector change detection addition unit 205, an individual area change amount conversion unit 206, a characteristic amount detection unit 3, a characteristic amount storage unit 4, a diagnostic region determination unit 5, a backlight brightness preliminary decision unit 6, a periodicity determination unit 102, a scene change determination unit 9, and a backlight brightness decision unit 103.

The liquid crystal panel unit 1, the backlight module unit 2, the characteristic amount detection unit 3, the characteristic amount storage unit 4, the diagnostic region determination unit 5, the backlight brightness preliminary decision unit 6, the periodicity determination unit 102, and the scene change determination unit 9, as explained in the first and second embodiments, are the same as those of the first and second embodiments, and hence, the explanation thereof is omitted.

The frame memory 201 stores image data of a current frame and image data of one frame before (hereinafter referred to as the last frame). The image data thus stored are outputted to the moving vector detection unit 202 according to a request from the moving vector detection unit 202.

The moving vector detection unit 202 divides the image data more finely than the block division of the backlight, detects divided areas which have high similarity between the present frame and the last frame, for each of the divided areas thus divided finely, and obtains moving vectors based thereon. In order to detect the divided areas having high similarity, the moving vector detection unit 202 obtains an absolute value of a difference (hereinafter referred to as a absolute difference value) between the gradation values of pixels with the same relative positions within the individual divided areas, in a first divided area (e.g., the current frame) in which a moving vector is to be detected and a second divided area (e.g., the last frame) which is to be compared with the first divided area. Subsequently, the moving vector detection unit 202 calculates a total sum of absolute difference values in the first and second divided areas for each pixel thus obtained. The moving vector detection unit 202 detects a divided area in which this total sum becomes the smallest, and determines that the divided area thus detected is a divided area with the highest similarity to the divided area in which a moving vector is to be detected. The moving vector detection unit 202 divides image data of each of the frames into finely divided areas (divided sub-areas) of k (in a horizontal direction)×l (in a vertical direction) ($k>m$, $l>n$). By adding absolute difference values for all the pixels within each divided sub-area, the moving vector detection unit 202 obtains a total sum of the absolute difference values in each divided sub-area. The moving vector detection unit 202 obtains a combination of divided sub-areas for which the value of the total sum becomes the smallest, and then obtains a moving vector from the positional relationship (distance and direction) between central pixels in the divided sub-areas. The moving vector detection unit 202 transmits moving vectors obtained in this manner to the moving vector storage unit 203.

The moving vector storage unit 203 stores the information on the moving vector (i.e., the direction and magnitude) of each divided sub-area detected by the moving vector detection unit 202 for the two frames. The moving vector storage unit 203 outputs the information on the moving vector (the direction and magnitude) thus stored to the moving vector change detection unit 204 according to a request of the moving vector change detection unit 204.

The moving vector change detection unit 204 compares the direction and magnitude of a moving vector for the two frames obtained from the moving vector storage unit 203 for each divided sub-area, and detects a divided sub-area with a change in either of the direction and the magnitude thereof. The detection result is set to "1" for a divided sub-area with a change, and to "0" for a divided sub-area without any change. The moving vector change detection unit 204 transmits the detection result to the moving vector change detection addition unit 205.

The moving vector change detection addition unit 205 adds the detection results for individual divided sub-areas detected by the moving vector change detection unit 204 for a plurality of frames for each divided sub-area. The result of the addition shows the number of frames with a change of a moving vector in the plurality of frames for each divided sub-area. An example of the results of addition for each divided sub-area is shown in FIG. 15. FIG. 15 shows the results of addition in the case of dividing image data into divided sub-areas of 30 (in the horizontal direction)×21 (in the vertical direction) (k=30, l=21), wherein a numerical value in each divided sub-area represents the number of frames in which a change in a moving vector has occurred within a period of time of a plurality of frames (e.g., 3,600 frames). Explaining this with the example of the input image of FIG. 2, in divided sub-areas corresponding to background regions and a GUI (menu bar) of an image display application, the magnitude of a moving vector is always 0 and there is no change, so the results of addition become zero. However, in divided sub-areas with a change, the results of addition become numerical values of 100-250. The moving vector change detection addition unit 205 outputs the results of addition to the individual area change amount conversion unit 206. Here, note that the moving vector change detection addition unit 205 resets the results of addition to 0, at the time of receiving the detection of a scene change from the scene change determination unit 9.

The individual area change amount conversion unit 206 converts a value of each of k×l divided sub-areas into a value of each of m×n divided areas for obtaining a moving vector in each result of addition. In this embodiment, the division by the divided areas is 10×7, and the division by the divided sub-areas is 30×21, so a region composed of nine (3×3) divided sub-areas in the entire divided sub-areas for detection of moving vectors corresponds to one divided area. Also, in this embodiment, a maximum value among the results of addition (the number of frames in which a change has occurred in moving vectors) in each nine (3×3) divided sub-areas is obtained, and the maximum value thus obtained is used as a value for determining the periodicity of a divided area composed of the nine (3×3) divided sub-areas. The results of the maximum value of the number of frames in which a change has occurred in a moving vector in each divided area are shown in FIG. 16. The individual area change amount conversion unit 206 transmits the results thus obtained to the periodicity determination unit 102.

The periodicity determination unit 102 detects candidates for periodical diagnostic regions from the results of the maximum value of the number of frames in which a change has occurred in a moving vector in each divided area, obtained from the individual area change amount conversion unit 206. The periodicity determination unit 102 makes a determination that a divided area, for which the maximum value of the number of frames in which a change has occurred in a moving vector is equal to or larger than a threshold value, is a candidate for a periodical diagnostic region. Assuming that the threshold value is set to 10, the results of the periodicity determination are shown in FIG. 17. The periodicity determination unit 102 transmits the periodicity determination results to the backlight brightness decision unit 103.

In the above configuration, similar to the first embodiment, even in cases where an image is inputted in which the position of a bright object image varies in a dark background image is inputted, as shown in FIG. 2, it is possible to prevent the backlight from blinking thereby to partially or locally generate flicker. Also, by using the moving vectors, in dynamic or moving images in which characters or large objects on a screen go in a fixed direction, candidates for periodical diagnostic regions can be detected, whereby in such dynamic or moving images, too, it is possible to satisfy both the suppression of flicker and high reproducibility of gradation. Here, note that a detection method for a moving vector is not limited to the above-mentioned one, but instead, a moving vector may be detected, without dividing each divided area into divided sub-areas, while leaving divided areas as they are.

Fourth Embodiment

In the first through third embodiments, the blocks corresponding to divided areas which have been determined as periodical diagnostic regions are always made to turn on at a high brightness for diagnostic regions. However, in cases where a mouse cursor is on a background image, the characteristic amount (the maximum value of an RGB signal) of a divided area with the mouse cursor located therein becomes large, so it is misjudged that the divided area is a diagnostic region. When periodicity is determined based on a value which is obtained by integrating or adding the diagnostic region determination results for each divided area as in the second embodiment, the divided area with the mouse cursor located therein will be misjudged as a candidate for a periodical diagnostic region, so it will always be lit with a high brightness for diagnostic regions until a scene change occurs. That is, there has been a problem that in cases where the divided area, which has been misjudged as a diagnostic region though it is originally a background region, is located at a position away from the diagnostic region, only a block corresponding to that divided area is lit unnaturally brightly. Accordingly, in a fourth embodiment, with respect to a divided area which has been determined as a diagnostic region in an isolated and periodic manner, a determination that the divided area is a periodical diagnostic region is canceled. By this, it is possible to reduce useless high brightness lighting resulting from an incorrect determination that the divided area is a diagnostic region, owing to the mouse cursor.

Figure 18:
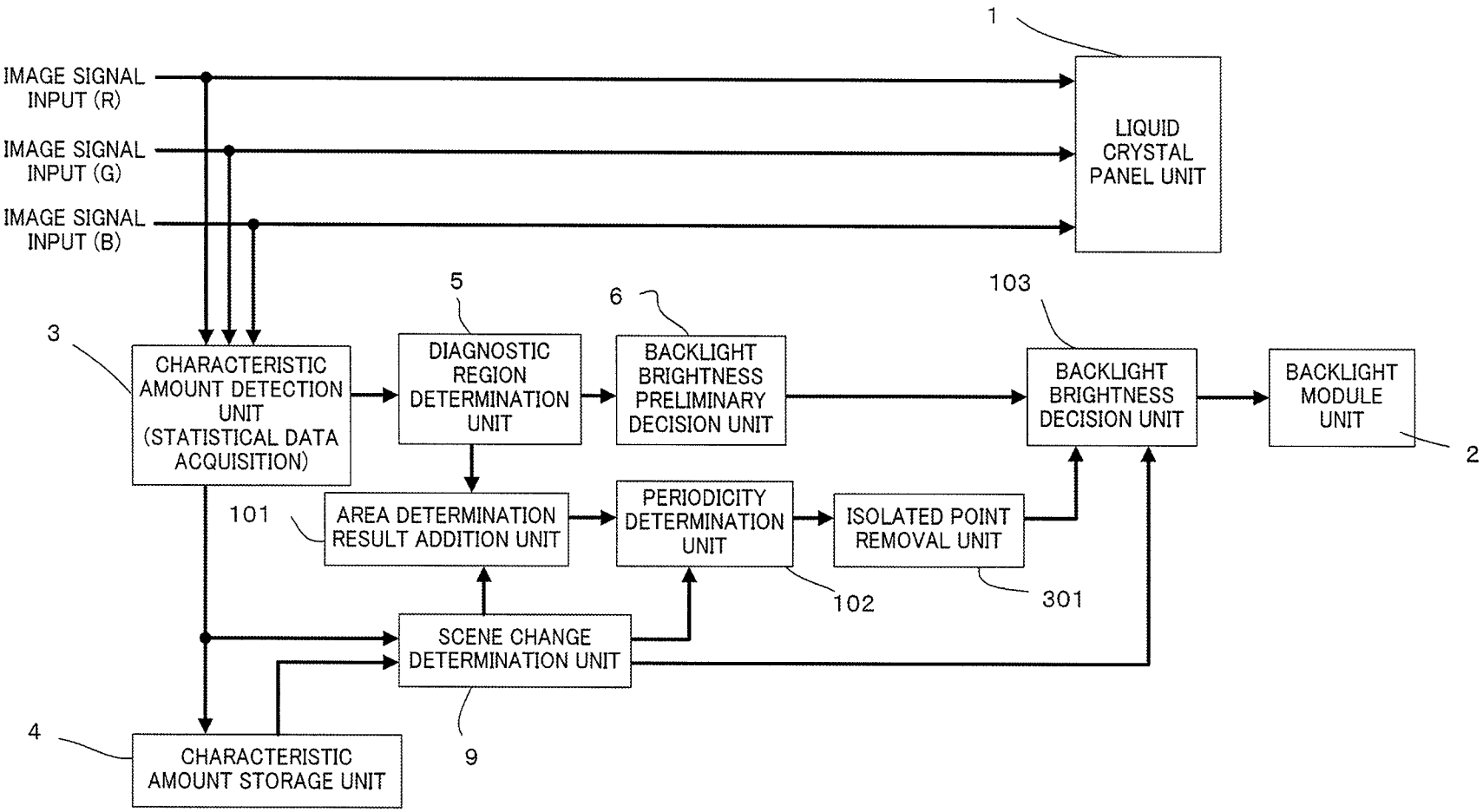
FIG. 18 is a functional block diagram of an image display apparatus according to a fourth embodiment of the present invention.

FIG. 18 shows a functional block diagram of an image display apparatus in the fourth embodiment of the present invention. As shown in FIG. 18, the image di splay apparatus of this embodiment is composed of a liquid crystal panel unit 1, a backlight module unit 2, a characteristic amount detection unit 3, a characteristic amount storage unit 4, a diagnostic region determination unit 5, a backlight brightness preliminary decision unit 6, an area determination result addition unit 101, a periodicity determination unit 102, an isolated point removal unit 301, a scene change determination unit 9, and a backlight brightness decision unit 103.

Figure 19:
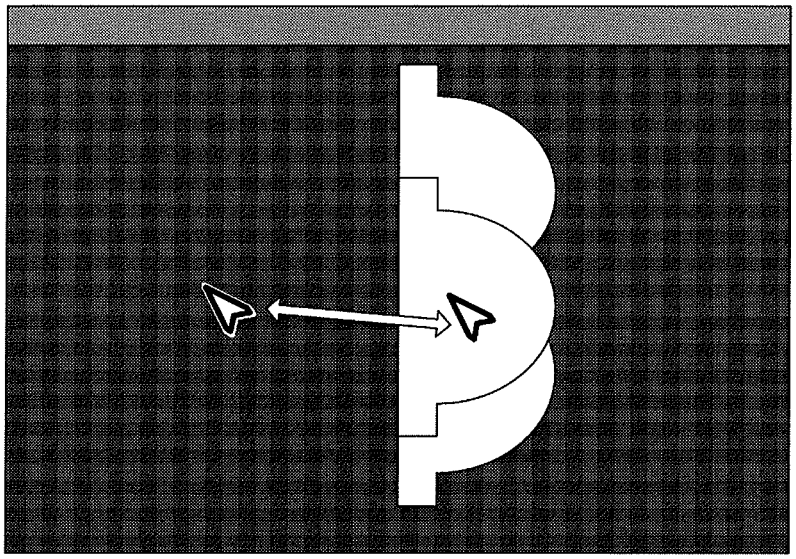
FIG. 19 is an example of input image data in the fourth embodiment.

Now, reference will be made, by way of example, to a case where a mouse cursor moves between a portion of a diagnostic image and a portion of a background image, as shown in FIG. 19. When the same diagnostic region determination as in the first and second embodiments is carried out, a block with the mouse cursor located therein is determined as a periodical diagnostic region. When the mouse cursor moves between the portion of the background image and the portion of the diagnostic image, as shown in FIG. 19, the results of addition in the area determination result addition unit 101 become as shown in FIG. 20. An added or integrated value in a block of coordinates (3, 4) which the mouse cursor moves toward and away from is 500. As a result, the periodicity determination unit 102 makes a determination that a divided area of coordinates (3, 4) is a periodical diagnostic region. The detection results of the periodicity determination unit 102 in the images of FIG. 19 are shown in FIG. 21.

Figure 22:
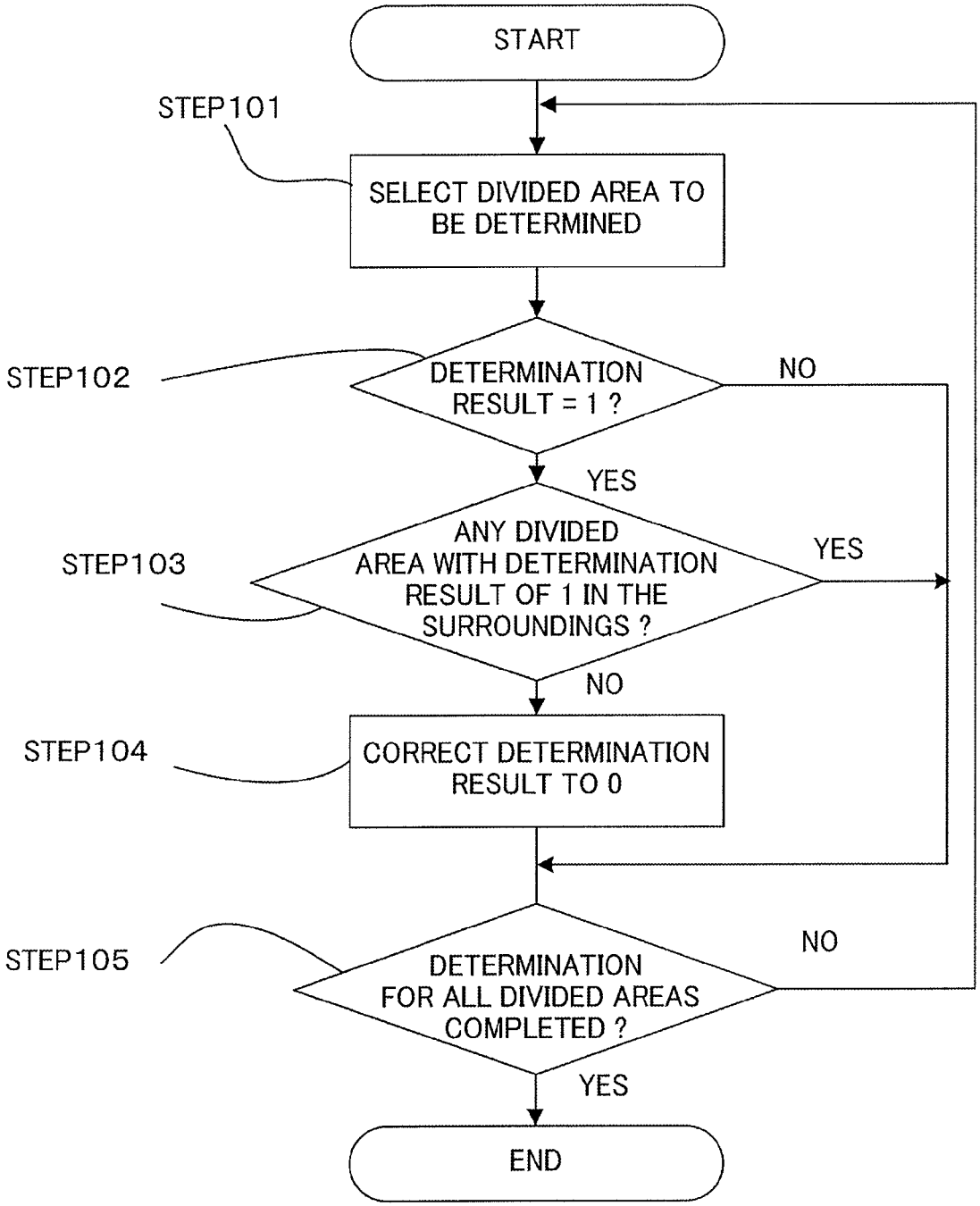
FIG. 22 is a flow chart diagram of processing of an isolated point removal unit in the fourth embodiment.

The isolated point removal unit 301 detects periodical diagnostic regions existing in an isolated manner in comparison with their surroundings in response to the determination results of the periodicity determination unit 102, and corrects the values of the periodical diagnostic regions, so that the determination results of the periodical diagnostic regions thus detected become background regions. A method for such detection will be explained by using a flow chart in FIG. 22.

In step 101, the isolated point removal unit 301 selects target divided areas to be determined (hereinafter simply referred to as target divided areas) as to whether or not they are isolated points. As for the order of selection, in this embodiment, the target divided areas are selected from a left uppermost divided area of coordinates (1, 1) as follows: (2, 1)→(3, 1)→ . . . →(10, 1)→(1, 2)→(2, 2)→ . . . →(10, 7). The isolated point removal unit 301 reads out the determination results about the target divided areas obtained by the periodicity determination unit 102. Then, the processing shifts to the following step 102.

In step 102, the isolated point removal unit 301 determines whether the target divided areas are candidates for periodical diagnostic regions. Values of the candidates for periodical diagnostic regions in the periodicity determination results obtained by the periodicity determination unit 102 are "1", so the isolated point removal unit 301 determines whether a periodicity determination result for each target divided area is "1". In cases where the periodicity determination result is "1", the processing in the isolated point removal unit 301 shifts to step 103, whereas if otherwise, the processing in the isolated point removal unit 301 shifts to step 105.

In step 103, the isolated point removal unit 301 determines whether the target divided areas are candidates for isolated periodical diagnostic regions. The isolated point removal unit 301 makes a determination according to whether a divided area of which a periodicity determination result is "1" exists in the surroundings of a target divided area. In this embodiment, it is checked whether there exists a periodicity determination result of "1" for any of those divided areas which are adjacent to a target divided area in its vertical and horizontal directions and in its oblique directions. In cases where there is no divided area with its periodicity determination result of "1" in the surroundings thereof, the isolated point removal unit 301 makes a determination that the target divided area is a candidate for an isolated periodical diagnostic region. In this case, the isolated point removal unit 301 makes a determination that the target divided area is not a periodical diagnostic region, and the processing shifts to step 104. The reason for making such a determination is that in the case of a diagnostic image such as a tomosynthesis image, etc., the area of the diagnostic image is large, and hence, exists over a plurality of divided areas. For that reason, in cases where one divided area is isolated from its surroundings and is determined as a candidate for a periodical diagnostic region, it is considered that the divided area is accidentally determined as a diagnostic region. On the other hand, in cases where there is a divided area with its periodicity determination result of "1" in the surroundings thereof, the isolated point removal unit 301 makes a determination that the target divided area is not a candidate for an isolated periodical diagnostic region, and maintains the periodicity determination result of the target divided areas as it is, and then, the processing shifts to step 105.

In step 104, the isolated point removal unit 301 corrects the periodicity determination result of the target divided area from "1" to "0". As a result of this, the determination about the divided area, which has been determined as a candidate for a periodical diagnostic region in an isolated manner, is corrected to a background region.

In step 105, the isolated point removal unit 301 checks whether determinations for all the divided areas have been completed, wherein in cases where all the determinations have been completed, the processing is ended, whereas in cases where they have not yet been completed, a return is made to step 101.

With the above flow, based on the periodicity determination results obtained by the periodicity determination unit 102, the isolated point removal unit 301 detects divided areas which are isolated from their surroundings and which have been determined as periodical diagnostic regions, and corrects the values for the divided areas thus detected, so that the periodicity determination results of the detected divided areas become background regions.

In the above configuration, similar to the first and second embodiments, even in cases where an image is inputted in which the position of a bright object image varies in a dark background image is inputted, as shown in FIG. 2, it is possible to suppress the backlight from blinking thereby to partially or locally generate flicker. In addition, in comparison with the second embodiment, an incorrect determination of a diagnostic region due to the mouse cursor can be suppressed, thus making it possible to suppress a block in an original background region from being lit wastefully with a high brightness.

The present invention is not limited to an image display apparatus which is provided with a liquid crystal panel as a display panel, but can be applied to image display apparatuses in general having a backlight of which local brightnesses can be controlled for each block.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment (s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-113160, filed on May 29, 2013, and Japanese Patent Application No. 2014-093398, filed on Apr. 30, 2014, which are hereby incorporated by reference herein in their entirety.

What is claimed is:

1. An image display apparatus comprising:

a light emitting unit composed of a plurality of light emitting blocks, the brightnesses of which are able to be adjusted individually;

a display unit configured to display an image by modulating light from the light emitting unit; and a decision unit configured to divide a frame image into a plurality of divided areas, to determine whether each of the divided areas is a first region including a predetermined object or a second region not including the predetermined object, and to decide a brightness of each light emitting block based on a result of the determination of each divided area;

wherein in cases where a divided area determined as the second region in a target frame for which brightnesses are to be decided has been determined as the first region in frames, which satisfy a predetermined condition, among past frames which precede the target frame, the decision unit decides the brightness of a light emitting block corresponding to the divided area to a brightness closer to the brightness of a light emitting block corresponding to a divided area determined as the first region as compared to the brightnesses of light emitting blocks corresponding to the other divided areas determined as the second region.

2. The image display apparatus as set forth in claim 1, wherein in cases where a divided area determined as the second region in a target frame for which brightnesses are to be decided has been determined as the first region in frames, which satisfy the predetermined condition, among past frames which precede the target frame, the decision unit decides the brightness of a light emitting block corresponding to the divided area to a brightness substantially equal to the brightness of a light emitting block corresponding to a divided area determined as the first region.

3. The image display apparatus as set forth in claim 1, wherein in cases where a divided area determined as the second region in a target frame for which brightnesses are to be decided has been determined as the first region in frames, which satisfy the predetermined condition, among past frames which precede the target frame, the decision unit decides the brightness of a light emitting block corresponding to the divided area to a brightness within a range of plus or minus 15% with respect to the brightness of a light emitting block corresponding to a divided area determined as the first region.

4. The image display apparatus as set forth in claim 1, wherein the decision unit decides the brightness of a light emitting block corresponding to a divided area determined as the first region to a brightness higher than the brightness of a light emitting block corresponding to a divided area determined as the second region.

5. The image display apparatus as set forth in claim 1, wherein the predetermined condition is that in a plurality of frames among past frames preceding the target frame, the determination result of the divided area changes from the second region to the first region, and that a variation in time intervals between the plurality of frames falls within a predetermined range.

6. The image display apparatus as set forth in claim 1, wherein the predetermined condition is that in a predetermined number or more of frames among past frames preceding the target frame, the determination result of the divided area changes from the second region to the first region.

7. The image display apparatus as set forth in claim 1, wherein the predetermined condition is that in past frames preceding the target frame, a determination result in which the divided area is the first region and a determination result in which the divided area is the second region are repeated in a periodic manner.

8. The image display apparatus as set forth in claim 1, wherein the predetermined condition is that in a predetermined number or more of frames among past frames preceding the target frame, the divided area has been determined as the first region.

9. The image display apparatus as set forth in claim 1, further comprising:

a determination unit configured to detect a motion vector for each divided area based on a difference in pixel values between divided areas in adjacent frames, and to determine for each divided area whether a change occurs in a motion vector from a preceding frame to a later frame of the adjacent frames;

the predetermined condition is that in a predetermined number or more of frames among past frames preceding the target frame, it has been determined that a change occurs in the motion vector in the divided area.

10. The image display apparatus as set forth in claim 9, wherein the determination unit divides the a divided area corresponding to each light emitting block into still finer divided sub-areas, and determines whether a change occurs in a motion vector for each divided sub-area; and the predetermined condition is that in a predetermined number or more of frames among past frames preceding the target frame, it has been determined that a change occurs in a motion vector in any of divided sub-areas included in the divided area.

11. The image display apparatus as set forth in claim 1, wherein in cases where there exists a divided area which is determined as the second region in the target frame, and which has been determined as the first region in frames, which satisfy the predetermined condition, among past frames which precede the target frame, the decision unit decides the brightnesses of all the light emitting blocks to the same brightness as that of a light emitting block corresponding to the divided area which has been determined as the first region.

12. The image display apparatus as set forth in claim 1, further comprising:

a detection unit configured to detect a scene change;

wherein the past frames which precede the target frame are frames from the last frame in which the scene change has been detected by the detection unit to the target frame.

13. The image display apparatus as set forth in claim 12, wherein the past frames which precede the target frame are a predetermined number of frames close to the target frame among frames from the last frame in which the scene change has been detected by the detection unit to the target frame.

14. The image display apparatus as set forth in claim 1, wherein the decision unit determines, based on a characteristic amount of an image in a divided area, whether the divided area is the first region or the second region.

15. The image display apparatus as set forth in claim 14, wherein in cases where a maximum pixel value of the image in the divided area is equal to or greater than a threshold value, the decision unit makes a determination that the divided area is the first region.

16. The image display apparatus as set forth in claim 1, wherein in cases where a divided area determined as the second region in the target frame has been determined as the first region in frames, which satisfy the predetermined condition, among past frames which precede the target frame, and where there exists no divided area, which has been determined as the first region in the target frame, in the surroundings of the divided area, the decision unit decides the brightness of a light emitting block corresponding to the divided area to a brightness lower than the brightness of a light emitting block corresponding to a divided area determined as the first region.

17. The image display apparatus as set forth in claim 1, wherein the decision unit obtains additional information added to image data inputted, and only in cases where the decision unit determines, based on the additional information, that the image data inputted is a predetermined kind of image data, the decision unit decides the brightness of a light emitting block corresponding to a divided area, which is determined as the second region in the target frame and which has been determined as the first region in frames, which satisfy the predetermined condition, among the past frames, to the same brightness as that of a light emitting block corresponding to the divided area which has been determined as the first region.

18. The image display apparatus as set forth in claim 17, wherein the predetermined kind of image data is medical image data.

19. A control method for an image display apparatus which includes:

a light emitting unit composed of a plurality of light emitting blocks, the brightnesses of which are able to be adjusted individually from one another; and a display unit configured to display an image by modulating light from the light emitting unit;

the method comprising:

dividing a frame image into a plurality of divided areas, determining whether each of the divided areas is a first region including a predetermined object or a second region not including the predetermined object, and deciding a brightness of each light emitting block based on a result of the determination of each divided area;

wherein in the deciding, in cases where a divided area determined as the second region in a target frame for which brightnesses are to be decided has been determined as the first region in frames, which satisfy a predetermined condition, among past frames which precede the target frame, the brightness of a light emitting block corresponding to the divided area is decided to a brightness closer to the brightness of a light emitting block corresponding to a divided area determined as the first region as compared to the brightnesses of light emitting blocks corresponding to the other divided areas determined as the second region.

20. The control method for an image display apparatus as set forth in claim 19, wherein in the deciding, in cases where a divided area determined as the second region in a target frame for which brightnesses are to be decided has been determined as the first region in frames, which satisfy a predetermined condition, among past frames which precede the target frame, the brightness of a light emitting block corresponding to the divided area is decided to a brightness substantially equal to the brightness of a light emitting block corresponding to a divided area determined as the first region.

21. The control method for an image display apparatus as set forth in claim 19, wherein in the deciding, in cases where a divided area determined as the second region in a target frame for which brightnesses are to be decided has been determined as the first region in frames, which satisfy a predetermined condition, among past frames which precede the target frame, the brightness of a light emitting block corresponding to the divided area is decided to a brightness within a range of plus or minus 15% with respect to the brightness of a light emitting block corresponding to a divided area determined as the first region.

* * * * *